US005249642A

United States Patent [19]

Kishi

[11] Patent Number: 5,249,642

[45] Date of Patent: Oct. 5, 1993

[54] LIFTING APPARATUS

[75] Inventor: Mitsuhiro Kishi, Tochigi, Japan

[73] Assignee: Japanic Corporation, Tochigi, Japan

[21] Appl. No.: 847,954

[22] Filed: Mar. 6, 1992

[30] Foreign Application Priority Data

Mar. 22, 1991 [JP] Japan ..... 3-081287
Aug. 13, 1991 [JP] Japan ..... 3-228336

[51] Int. Cl.[5] ..... B66F 11/00

[52] U.S. Cl. ..... 182/2; 182/19; 182/63; 187/9 R

[58] Field of Search ..... 182/2, 18, 19, 63, 141; 187/9 R, 9 E

[56] References Cited

U.S. PATENT DOCUMENTS 3,176,792 4/1965 Olson ..... 182/18 X
3,799,290 3/1974 Fisher ..... 182/19 X
4,456,093 6/1984 Finley et al. ..... 182/18 X
4,691,805 9/1987 Kishi ..... 182/2 X

FOREIGN PATENT DOCUMENTS 63-27280 6/1988 Japan .
63-59959 11/1988 Japan .
3-38194 6/1991 Japan .

*Primary Examiner*—Alvin C. Chin-Shue
*Attorney, Agent, or Firm*—Flynn, Thiel, Boutell & Tanis

[57] ABSTRACT

A lifting apparatus has a movable chassis, a vertically movable platform disposed over the chassis and a vertically swingable, telescopic boom body connected between the chassis and the platform. The chassis, boom body and platform are arranged to form a Z-shape in side view. A detecting mechanism for monitoring the movement of the platform includes a winding drum, and a detection wire wound on the winding drum and having an end fixed to the platform. The boom body is extended at a rate correlated to the angle of inclination of the boom body so that the platform remains horizontal while moving vertically relative to the chassis.

19 Claims, 33 Drawing Sheets

LIFTING APPARATUS

CROSS REFERENCE TO RELATED APPLICATION

The subject matter of this application is related to the subject matter of my copending U.S. Ser. No. 7/783,638 filed on Oct. 24, 1991, U.S. Pat. No. 5,211,259 issued May 18, 1993, the disclosure of which is incorporated herein by reference.

BACKGROUND OF THE INVENTION

1. Field of the Invention

The present invention relates to a lifting apparatus capable of moving a platform vertically above a chassis so as to raise and lower an operator, an object or material located on the platform and, more particularly, to a lifting apparatus having a simple structure composed of one telescopic boom body and, yet, which can function in a manner equivalent to that of a conventional lifting apparatus having plural telescopic boom bodies, and also having a simple structure composed of a slave-operated detecting mechanism which is capable of synchronizing an inclining operation and an elongating operation of the telescopic boom body so as to raise the platform vertically relative to the chassis.

2. Description of the Prior Art

Lifting apparatuses are widely used for assembling, painting and repairing highway bridges, building construction or the like, which occur at elevated locations. In such apparatuses, an operator, an object or material is placed on a platform which is then raised or lowered.

A conventional lifting apparatus comprises a plurality of groups of arms, wherein each group of arms comprises a pair of arms which are pivotally connected at the central portion thereof. The plurality of groups of arms are assembled as one unit for forming a pantograph by combining the plurality of groups of arms vertically (a so-called scissors-type lifting apparatus). In the conventional arrangement of such an apparatus, it is necessary to lengthen each arm or to increase the number of groups of arms to be connected with one another in order to increase the height to which the platform can be raised. Accordingly, if a lifting apparatus capable of raising a platform to a higher position is designed, a plurality of groups of pantographs are required. This involved the problem that when the lifting apparatus is in its collapsed state wherein the linkage is folded, the platform is higher than is desired and the operation of loading the operator or the material is troublesome.

There was proposed another lifting apparatus capable of stretching one arm in the longitudinal direction thereof by inserting a plurality of booms stretchably into an arm (as disclosed in, e.g., Japanese Patent Application No. 56-134487 and No. 56-191065). In that lifting apparatus, middle booms are rotatably assembled at the central portion thereof in an X-shape, and two groups of middle booms are arranged in parallel with each other wherein an upper boom and a lower boom are respectively inserted into each middle boom so as to connect the chassis to the platform. This lifting apparatus has the problem that the number of booms is increased and the number of components is also increased, which involves laborious work for manufacture and assembly thereof, with consequent high cost.

In that apparatus, the sliding portions of each boom are increased in size which required slidable parts composed of synthetic resins, such as polyamide, for keeping in good condition the zone in which the sliding portions slide. These sliding parts should be regularly replaced with new parts. This involves an increase of the number of sliding parts and laborious work for inspection and maintenance, and high cost thereof.

To solve these problems, there was proposed another lifting apparatus comprising one elongatable boom and forming a Z-shape viewed from the side (Japanese Patent No. 59-95797). In this mechanism, it is necessary to control the direction in which the one elongatable boom extends and to control the inclination angle for inclining the one elongatable boom upwardly and downwardly, wherein both controls should be made to operate in synchronism with each other. Both controls necessitate a telescopic measuring unit for measuring the elongation amount of a telescopic boom body and an angle measuring unit for measuring the inclination angle of the telescopic boom body relative to the horizontal, wherein both units issue detecting signals which are used to control a first hydraulic cylinder for adjusting the inclination angle and a second hydraulic cylinder for controlling telescoping of the boom. It is complex to arrange these two measuring units in the lifting apparatus in view of the complicated assembly thereof. Furthermore, a calculating computer, such as a microcomputer and the like, is required for calculating the detecting signals issued by the two measuring units. The measuring units and the computer, respectively, are high cost items, which result in an increase of the manufacturing cost of the lifting apparatus as a whole. The cost of the measuring units and the computer significantly influence the total cost of a small size lifting apparatus because the cost price ratio of the computer is high relative to the total cost of the small size lifting apparatus. The Z-shaped lifting apparatus has the advantages that it requires fewer components compared with the conventional scissors-type lifting apparatus and the X-shaped lifting apparatus. However, this Z-shaped lifting apparatus has a drawback in that the controlling mechanism is complex and involves high cost because the telescopic boom body should be controlled in respect of inclination angle and lengthwise extension and contraction.

Accordingly, it is desired to provide a simplified control mechanism capable of lifting the platform vertically relative to the chassis without the need of measuring units for measuring the elongation of the telescopic boom body and the inclination angle of the telescopic boom body and without providing a computer for calculating the detecting signals issued by these measuring units. Particularly, the control mechanism can mechanically control the platform relative to the chassis without resorting to electronic instruments such as high-priced computers.

It is an object of the present invention to provide a lifting apparatus comprising a movable chassis, a platform disposed over the chassis, an elongated telescopic boom body extending between the chassis and the platform and comprising a plurality of boom sections which are telescopable into and out of the telescopic boom body in the longitudinal direction thereof, inclining means interposed between the chassis and the telescopic boom body for raising the telescopic boom body so that it is inclined with respect to the chassis, extension means housed within the telescopic boom body for telescoping the boom body to elongate and contract the same, wherein the platform, the telescopic boom body and the chassis are arranged to form a Z-shape when viewed from the side thereof and the telescopic boom body is telescopically moved and inclined relative to the chassis so as to move the platform vertically relative to the chassis while the platform is kept horizontal relative to the chassis, characterized in that: the lifting apparatus further comprises a slave-operated detecting mechanism including first and second winding drum, a first extension wire which has an end fixed to one lower surface of the platform and another end wound around the first winding drum and a second extension wire which has an end fixed to another lower surface of the platform and another end wound around the second winding drum.

It is an object of the present invention to provide a lifting apparatus comprising a tuning device including a winding drum and a detection wire which has an end fixed to one lower surface of the platform and another end wound around the winding drum.

DETAILED DESCRIPTION

A lifting apparatus according to a first embodiment of the present invention will be described hereinafter with reference to FIGS. 1 to 15.

Figure 1:
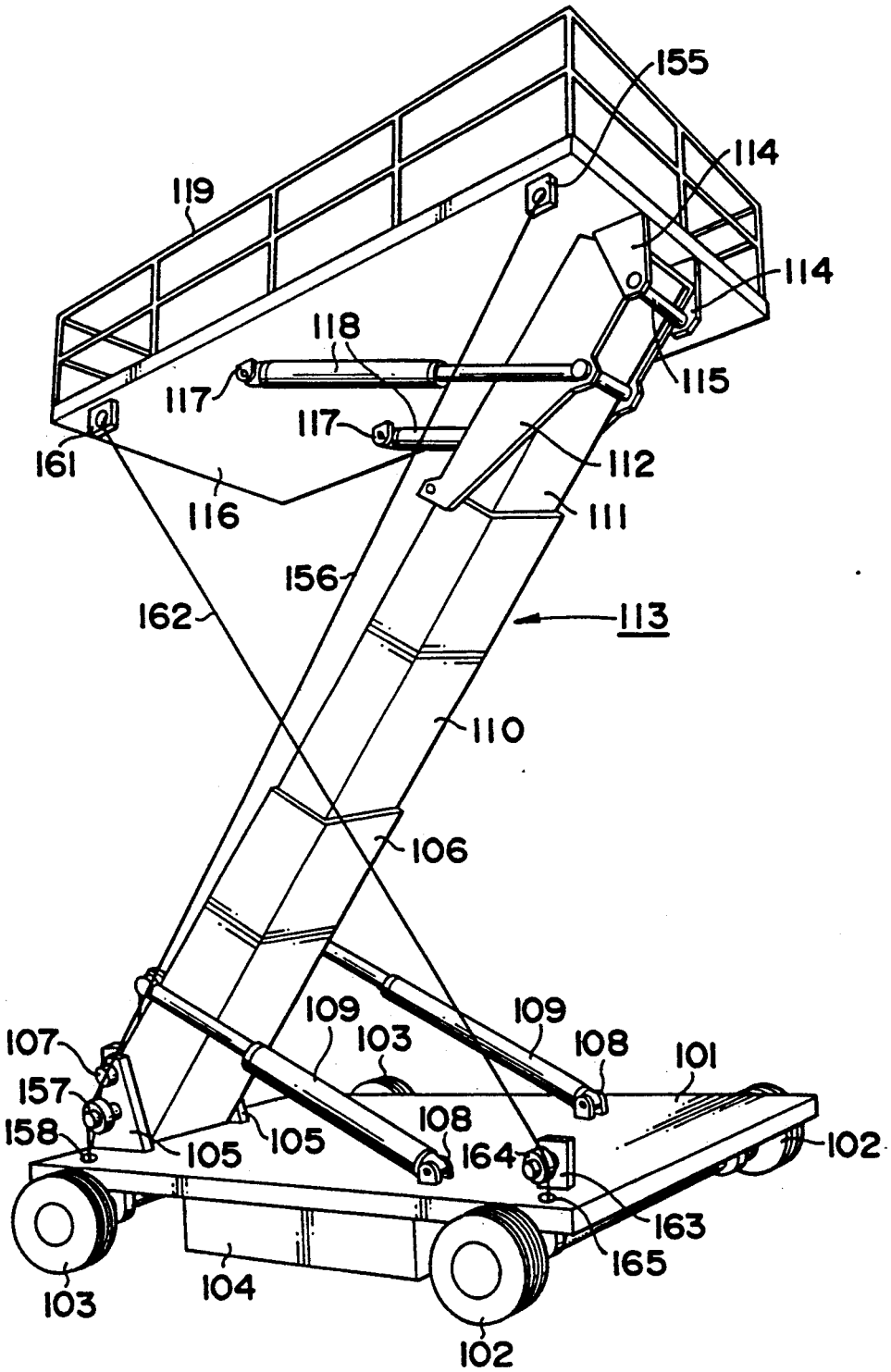
FIG. 1 is a perspective view showing a state wherein a platform, one of the components of the lifting apparatus according to a first embodiment of the present invention, is at its maximum height.
Figure 2:
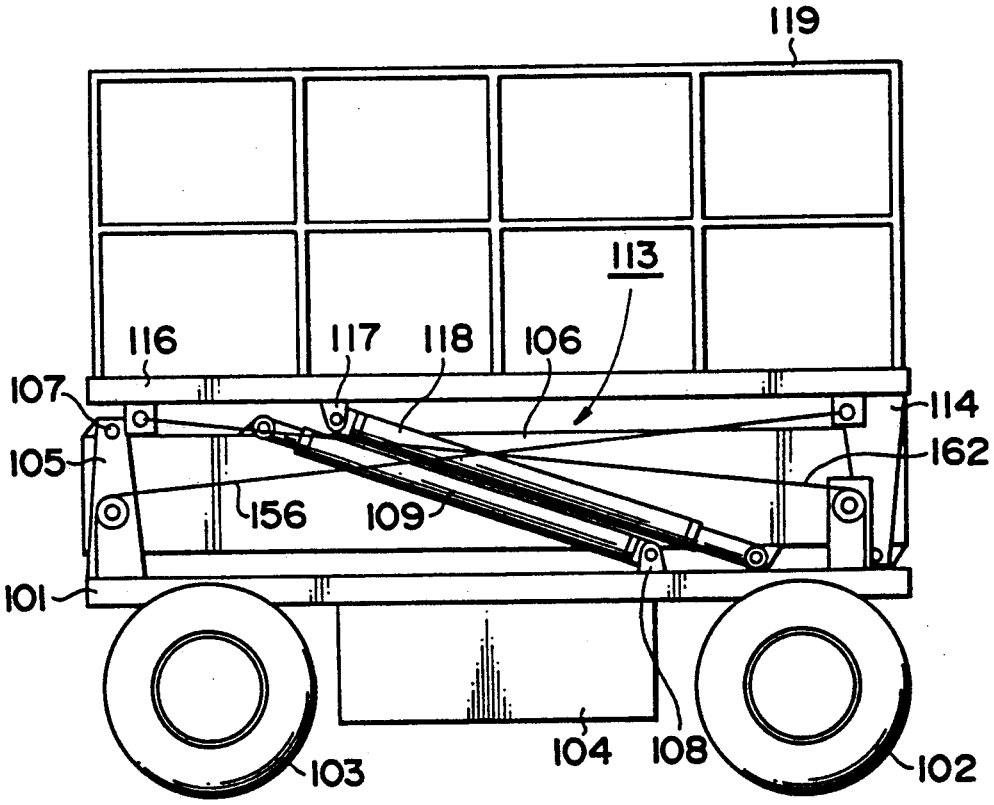
FIG. 2 is a side view showing a state wherein the platform is at its lowest position.
Figure 3:
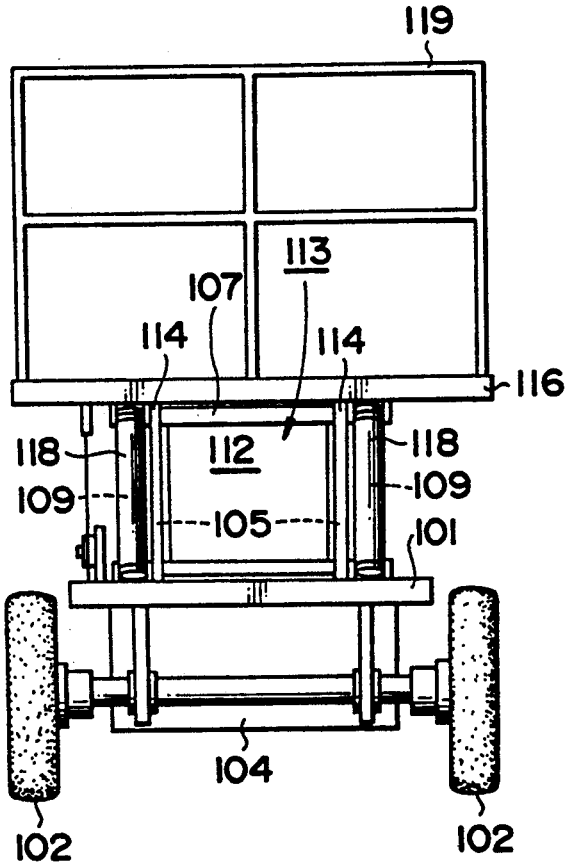
FIG. 3 is a front view of the lifting apparatus in FIG. 2.
Figure 4:
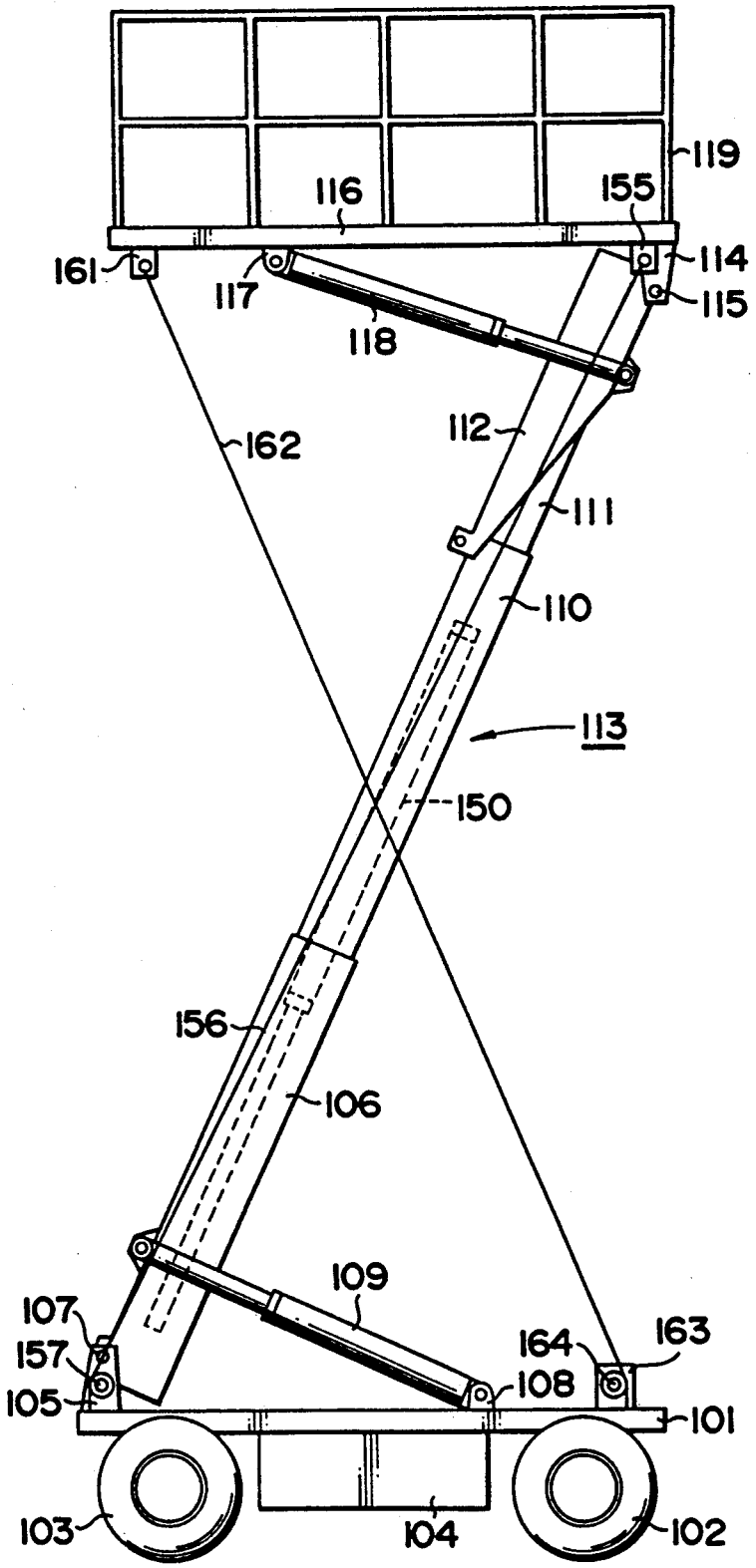
FIG. 4 is a side view showing a state wherein the platform is raised to its maximum height.

FIG. 1 is a perspective view showing a state wherein a platform, one of the components of a lifting apparatus according to a first embodiment of the present invention, is at its maximum height, FIG. 2 is a side view showing a state where the platform is at its lowest position, FIG. 3 is a front view of the lifting apparatus in FIG. 2, and FIG. 4 is a side view showing a state wherein the platform is raised to its maximum height.

A chassis 101 of the lifting apparatus is supported by a pair of front wheels 102 and a pair of rear wheels 103, located at the front and rear portions thereof and at the left and right sides thereof, whereby the chassis 101 is freely movable along the ground. A drive housing 104 containing therein an engine, a hydraulic pump and related equipment is attached to the lower portion of the chassis 101. A pair of supporting brackets 105 are fixedly mounted on the upper surface of the chassis 101 at one side thereof (at the side close to the rear wheels 103) with there being a preselected space between said brackets.

A lower boom 106, which is hollow and of square cross-section, is disposed between the supporting brackets 105. The supporting brackets 105 and the lower end of the lower boom 106 are respectively pivotally connected with each other by pins 107 so that the lower boom 106 can be pivoted upwardly and downwardly relative to the chassis 101. The pins 107 are pivotally supported by the supporting brackets 105. A pair of mounting members 108 are fixed to the upper surface of the chassis 101 and are disposed opposite to the supporting brackets 105 (toward the front side of the chassis) and on the opposite lateral sides of the lower boom 106. A pair of first hydraulic cylinders 109 serve as an inclining means for changing the angle of inclination (hereinafter referred to as inclination angle) of the lower boom 106 relative to the chassis 101. Corresponding ends of the cylinders 109 are disposed between and are pivotally connected to the mounting members 108. The other ends of the cylinders 109 extend on opposite sides of the lower boom 106 and are pivotally connected thereto.

The lower boom 106 has an open upper end which is square in cross section. A middle boom 110, which also is hollow and of square cross section, telescopically slidably extends into the central opening of the lower boom 106 for lengthwise movement in the longitudinal direction thereof. An upper boom 111, which also is hollow and of square cross section, similarly telescopically slidably extends into the central opening of the middle boom 110 at the open upper end thereof for lengthwise movement therein. A cover body 112, which has an inverted U-shaped cross section (see FIGS. 1 and 6) and which is open along the lower side thereof, is fixed to the upper end of the upper boom 111. The upper inside surface of the upper wall of the cover body 112 is spaced from and extends in parallel with the upper outside surface of the lower boom 106 when the lifting apparatus is in its collapsed state (FIGS. 2 and 3). The opposed walls of the upper boom 111 and the cover body 112 are spaced apart to define a gap therebetween in which the lower boom 106 can be received. Each of the lower boom 106, the middle boom 110 and the upper boom 111 has a length substantially the same as that of the chassis 101. The lower boom 106, the middle boom 110 and the upper boom 111 collectively define a telescopic boom body 113.

Designated at 116 is a platform having a floor area which is substantially the same as that of the chassis 101. A pair of supporting pieces 114 are fixed to the lower surface of the platform 116 close to the front end thereof (at the side of the front wheels 102). The upper end of the cover body 112 is inserted between the supporting pieces 114. The cover body 112 is pivotally connected to the supporting pieces 114 by a pin 115. A pair of mounting members 117 are fixed to the lower surface of the platform 116 at locations spaced from the shaft-supporting pieces 114 (toward the side close to the rear wheels 103). A pair of second hydraulic cylinders 118 for positioning the platform 116 relative to the chassis 101 are pivotally connected to the mounting members 117 and extend between the mounting members 117 and the opposite sidewalls of the cover body 112 to which the cylinders 118 are also pivotally connected. A handrail 119 is mounted on the upper side of the platform 116 for preventing material or an operator on the platform from falling off.

A first wire hanger 155 is fixed to the lower surface of the platform 116 at a location close to the shaft-supporting pieces 114 (right side in FIGS. 1, 2 and 4) while a second wire hanger 161 is fixed to the lower surface of the platform 116 at a location close to the mounting members 117 (left side in FIGS. 1, 2 and 4). A first extension wire 156, which is composed of a plurality of flexible twisted small metal wires, has one end connected to the first wire hanger 155 and extends downward along the inclined scope of the telescopic boom body 113. The first extension wire 156 is wound around a pulley 157, which is supported on the supporting bracket 105, and is inserted into a first drawing hole 158, which penetrates one end of the chassis 101. A second extension wire 162, which is also composed of a plurality of flexible twisted small metal wires, has one end connected to the tip end of the second wire hanger 161 and extends toward the front end of the chassis (right side in FIGS. 1, 2 and 4).

A thin holding plate 163 protrudes from one corner of the upper surface of the front end of the chassis 101 and supports a pulley 164 at the side surface thereof. The second extension wire 162 contacts along the outer periphery of the pulley 164 and is directed downward therefrom and then inserted into a second drawing hole 165 which penetrates the front end of the chassis 101. The first and second extension wires 156 and 162 stretch in an X-shape between the chassis 101 and the platform 116.

Figure 5:
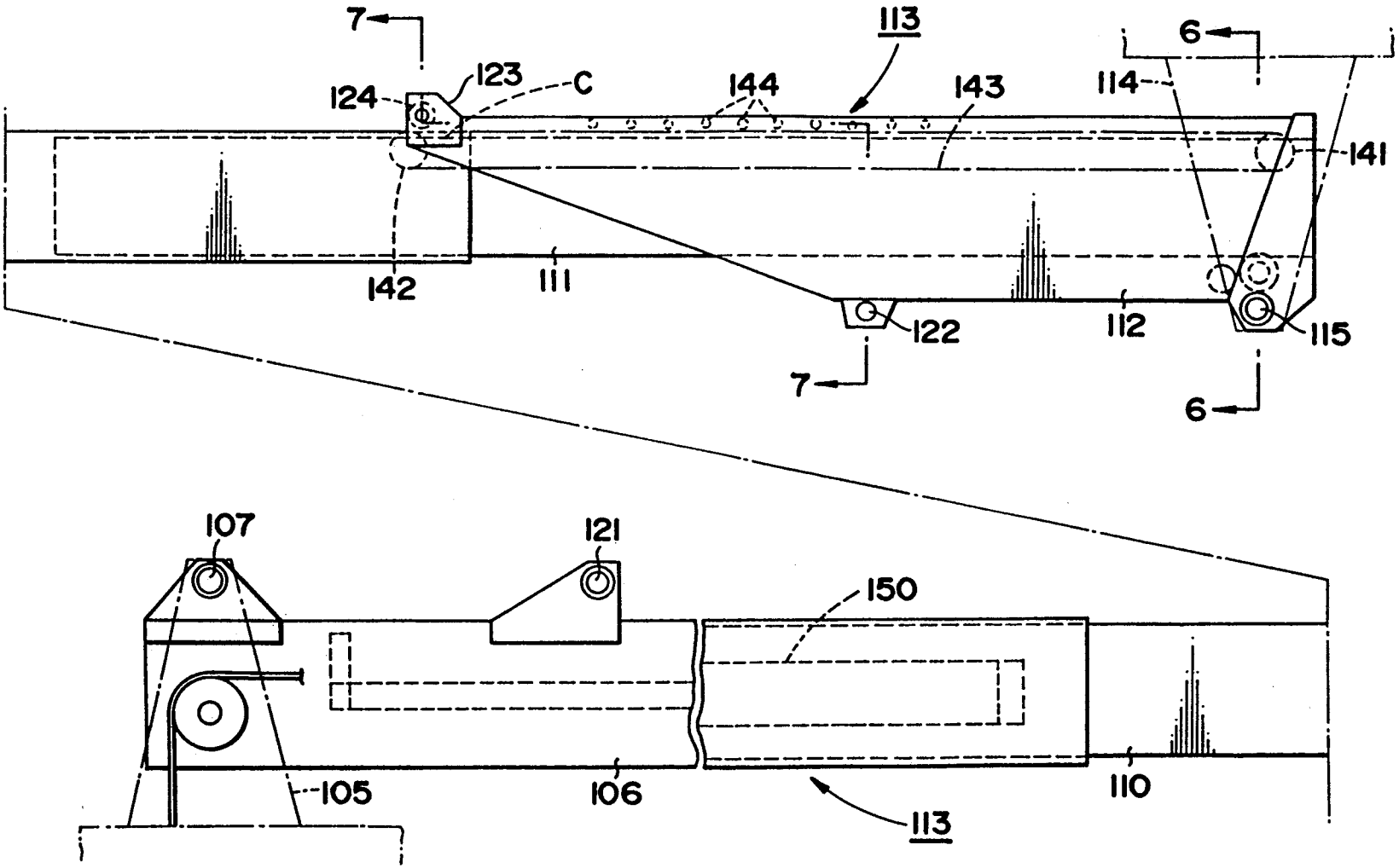
FIG. 5 is a schematic side view showing the internal structure of the telescopic boom body.

FIG. 5 schematically shows the internal structure of the telescopic boom body 113. The upper boom 111 and the middle boom 110 are respectively telescopically receivable into each other and into the lower boom 106. The cover body 112 is attached to the upper boom 111 and has an upper side, the length of which is about two-thirds of the total length of the lower boom 106. The cover body 112 has a lower side the length of which is about one-third of the total length of the lower boom 106. The left edge (in FIG. 5) of the cover body 112 slants to the right in the downward direction thereof. Pin holes 121 are provided on the upper side of the lower boom 106 at a position located about one-third of the total length thereof from the left end thereof, for connecting the first hydraulic cylinders 109 to the lower boom 106. Pin holes 122 are provided at the lower edge of the cover body 112 at a position located about one half of the entire length thereof, for connecting the second hydraulic cylinders 118.

Support portions 123 are fixed at the upper edge of the cover body 112 at the left end thereof. Rollers 124 are supported by the shaft supporting portions 123 so as to rollably contact the upper surface of the lower boom 106. A pair of sprocket wheels 141 are supported inside of and at the upper end of the upper boom 111 (right side in FIG. 5, see also FIG. 6). A second pair of sprocket wheels 142 are supported inside of and at a position located one-third of the total length of the upper boom 111 from the lower end thereof (left side in FIG. 5). Chains 143 are entrained around the sprocket wheels 141 and 142. The ends of the chains 143 are anchored at the upper end of the middle boom 110 (at the position denoted at C in FIG. 5). Ten rollers 144 are supported on each chain 143 and are spaced apart from each other along the upper side of each of the chains 143. The rollers 144 serve as spacers and they are low-friction slidable materials formed of polyamide resin. The rollers 144 rollably contact the inner surface of the upper wall of the cover body 112 (FIG. 6).

Figure 6:
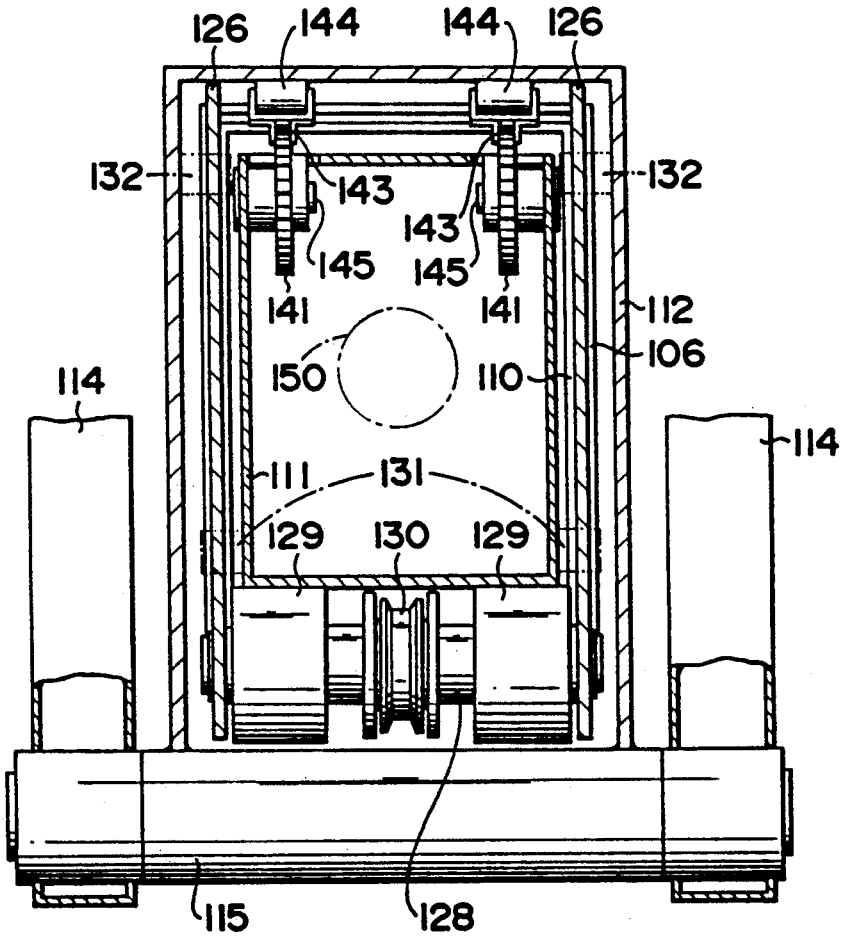
FIG. 6 is a cross-sectional view taken along the cutting line 6—6 in FIG. 5 and showing the telescopic boom body in its extended position.

FIG. 6 is a cross-sectional view taken along the cutting line 6—6 of the telescopic boom body in FIG. 5, showing the boom body in its extended position.

Auxiliary plates 126 are fixed to both sides of the upper or tip end of the middle boom 110 (right end in FIG. 5). A supporting shaft 128 is fixed at the lower portion of the auxiliary plates 126 and rollers 129 are rotatably supported by the supporting shaft 128 and disposed inside the auxiliary plates 126 so as to rollably contact with the lower surface of the upper boom 111. A pulley 130 is supported by the supporting shaft 128 at the central portion thereof for rotating chains (not shown) to connect the lower boom 106 with the upper boom 111. The auxiliary plates 126 have sliders 131 for slidably contacting the outside of the upper boom 111 and sliders 132 for slidably contacting an inner portion of the cover body 112. The pair of sprocket wheels 141 are supported by shafts or pins 145 at the upper portion of the inner wall of the upper boom 111 at the right and left sides thereof and the chains 143 are entrained around each sprocket wheel 141. The plurality of spacer rollers 144 are provided close to each chain 143 and in a spaced relation thereto.

Figure 7:
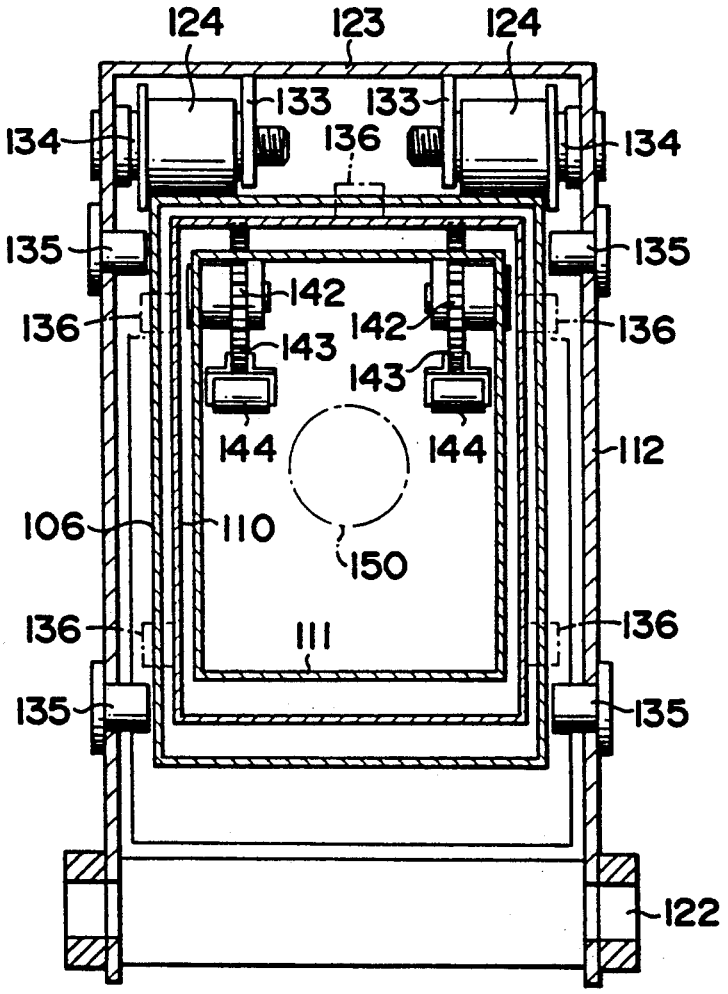
FIG. 7 is a cross-sectional view taken along the cutting line 7—7 in FIG. 5 and showing the telescopic boom body in its contracted position.

FIG. 7 is a cross-sectional view taken along the cutting line 7—7 of the telescopic boom body in FIG. 5, showing the boom body in its retracted position.

A pair of supporting pieces 133 are fixed to the inner Wall of the shaft-supporting portion 123 at the right and the left sides thereof so as to be positioned in parallel with the side walls of the shaft supporting portion 123. Pins 134 are supported between the side surfaces of the shaft-supporting portion 123 and each supporting piece 133. The rollers 124 are each respectively supported by a pin 134. The rollers 124 are adapted to rollably contact the upper surface of the lower boom 106 when the telescopic boom body is fully telescoped. Liners 135 are fixed to the side surfaces of the cover body 112 so as to slidably contact the lower boom 106. Liners 136 are fixed to the lower boom 106 so as to slidably contact the periphery of the middle boom 110. The sprocket wheels 142 are supported on the inner wall of the upper boom 111 at the right and left sides thereof and on the lower portion thereof and the chains 143 are entrained around the sprocket wheels 142.

Figure 8:
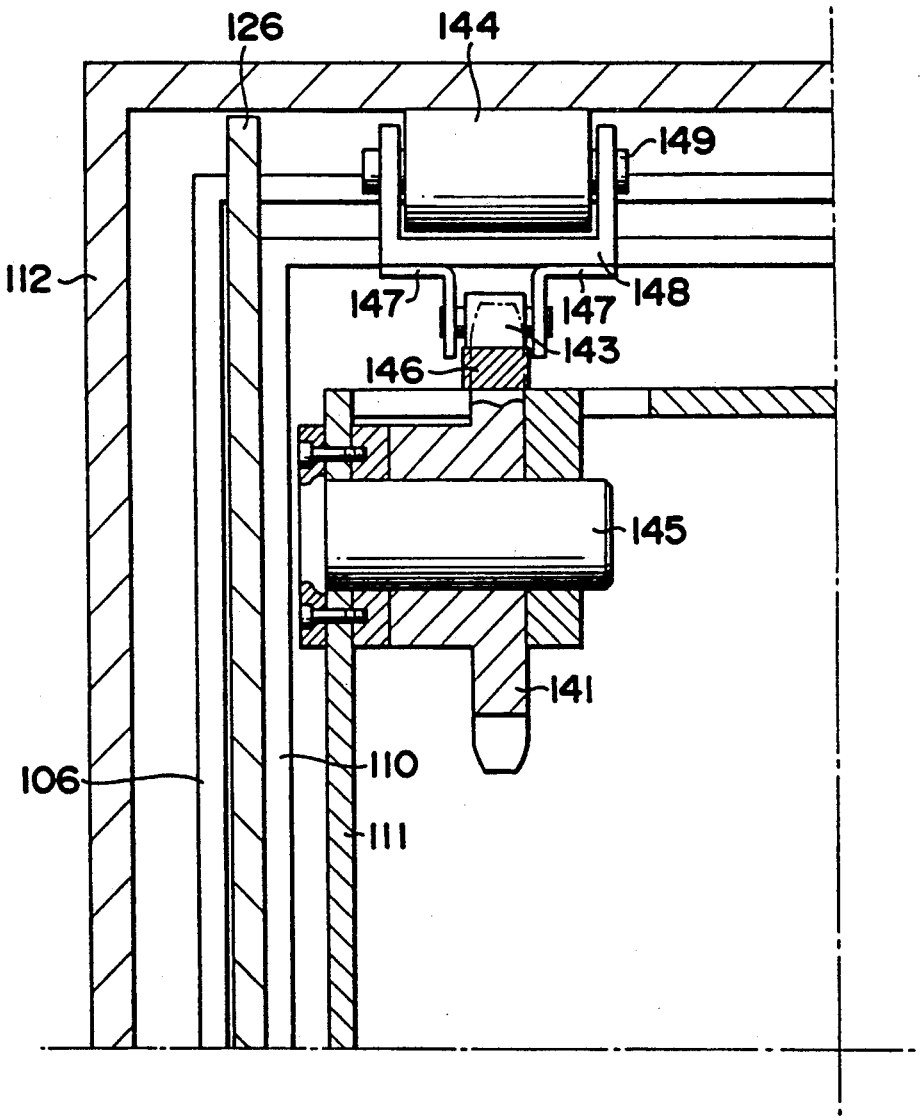
FIG. 8 is an enlarged, cross-sectional view of a fragment of FIG. 6 and showing a portion close to the rollers provided on the upper boom.

FIG. 8 is an enlarged view showing a portion close to the sprocket wheels 141 at the left side in FIG. 6.

The pin 145 protrudes inwardly from the inner wall of the upper boom 111. The sprocket wheel 141 is rotatably supported by the pin 145. The chain 143 is entrained around the sprocket wheel 141. A rail 146 formed of a synthetic resin, such as polyamide, is fixed to the upper surface of the upper boom 111 and is disposed in parallel with the longitudinal direction of the upper boom 111. The rollers of the chain 143 contact the upper surface of the rail 146 so that the rollers of the chains 143 can rotate therearound. A pair of angled pieces 147 formed in an L-shape are connected to opposite sides of the chain 143. A shaft-supporting body 148, which is open at the upper portion thereof and formed in a U-shape, is fixed between the angled pieces 147. The shaft 149 supporting the rollers 144 is fixed to the shaft supporting body 148.

Figure 9:
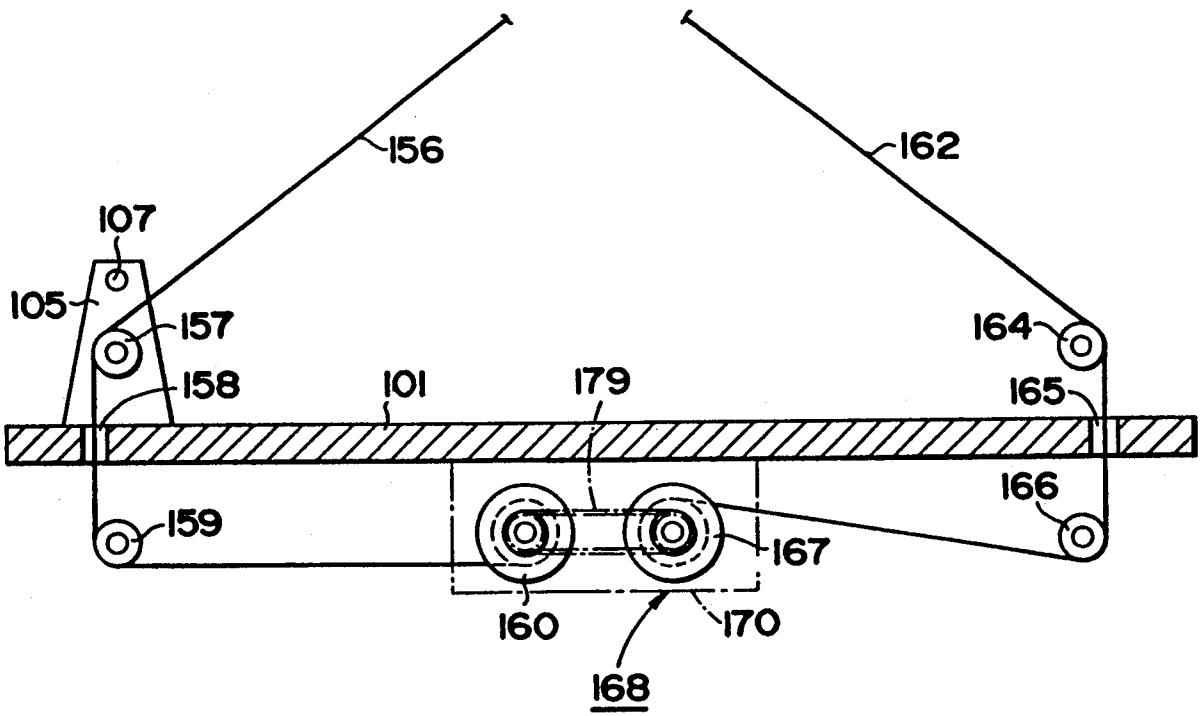
FIG. 9 is a cross-sectional side view showing an arrangement of a slave operated detecting mechanism, one of the components of the lifting apparatus.
Figure 10:
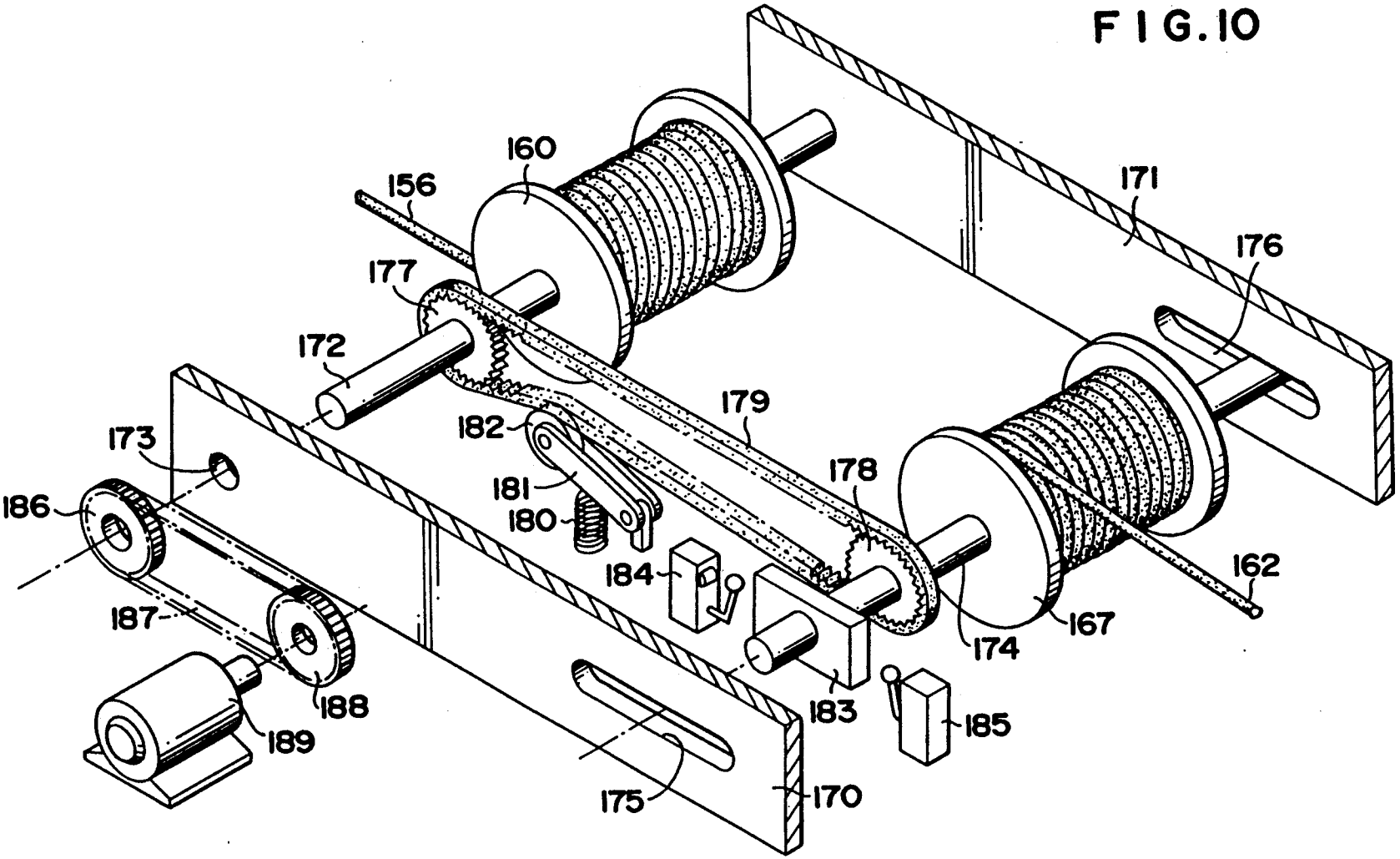
FIG. 10 is an exploded perspective view showing a main portion of the slave operated detecting means of FIG. 9.

FIGS. 9 and 10 show a slave-operated detecting mechanism 168 in detail, which synchronizes the elongating motion and the inclining motion of the telescopic boom body 113.

The first extension wire 156 extends aslant from the first wire hanger 155 provided at one lower surface of the platform 116 and contacts the pulley 157 which is supported by the supporting bracket 105. The first extension wire 156 is inserted into the first drawing hole 158, extends vertically and contacts a pulley 159, which is supported under the first drawing hole 158. The first extension wire 156 is reversed by the pulley 159 in the horizontal direction and wound around a first winding drum 160 of the slave-operated detecting mechanism 168. The second extension wire 162 extends aslant from the second wire hanger 161 provided at the other lower surface of the platform 116 and contacts the pulley 164 which is supported by the holding plate 163 at the front end of the chassis 101. The second extension wire 162 is inserted into the second drawing hole 165, extends vertically and contacts a pulley 166, which is supported under the second drawing hole 165. The second extension wire 162 is reversed by the pulley 166 in the horizontal direction and wound around a winding drum 167 of the slave-operated detecting mechanism 168.

The slave-operated detecting mechanism 168 controls to synchronize the elongating length and inclining angle of the telescopic boom body 113 and is supported as a whole by a pair of supporting plates 170 and 171, which are fixed to the central lower surface of the chassis 101. Both the supporting plates 170 and 171 are formed of thin metals and spaced in parallel with each other. The winding drums 160 and 167 are rotatably supported by the supporting plates 170 and 171 A shaft 172 penetrates the center of the winding drum 160 and fixed thereto and is supported by a holding hole 173 defined in the supporting plate 170. A shaft 174 penetrates the center of the winding drum 167 and fixed thereto and is supported by long holes 175 and 176 which are defined in the supporting plates 170 and 171. The long holes 175 and 176 are open long in the supporting plates 170 and 171 so as to extend horizontally, whereby the shaft 174 is rotatably supported by the long holes 175 and 176 so as to be movable horizontally. Sprocket wheels 177 and 178 are fixed to the respective shafts 172 and 174 and a chain 179 is entrained around both the sprocket wheels 177 and 178 so that both the shafts 172 and 174 rotate at the same speed. Both the shafts 172 and 174 are restricted by the chain 179 so as to have the same turning angles. An arm 181, which is always urged upward by a spring 180, is disposed under the chain 179 A tension roller 182, which is provided at the tip end of the arm 181, is permitted to always contact the lower surface of the chain 179 to keep the chain 179 from slacking. The shaft 174 is rotatably inserted into a contact plate 183 and limit switches 184 and 185 are positioned at right and left sides of the contact plate 183. A sprocket wheel 186 is fixed to the shaft 172 outside of the supporting plate 170 and a chain 187 is entrained around the sprocket wheel 186 and a sprocket wheel 188 which is connected to a motor 189.

Figure 11:
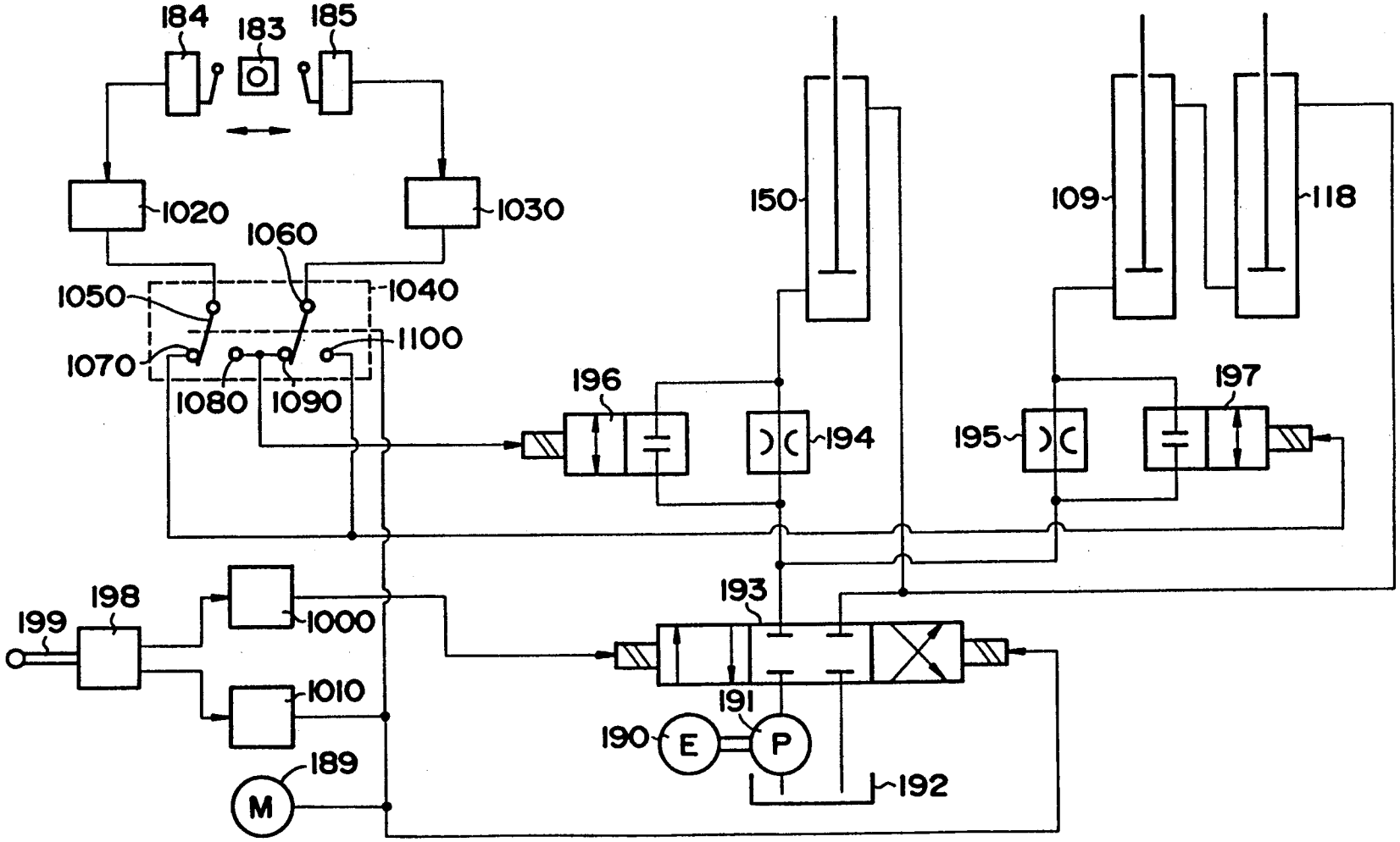
FIG. 11 is a hydraulic circuit diagram showing a control system of the lifting apparatus.

FIG. 11 is a hydraulic circuit diagram of the lifting apparatus according to the present invention.

A hydraulic pump 191 driven by an engine 190 has a suction side communicating with an oil tank 192 and a discharge side connected to a solenoid control valve 193 which is switchable into three positions. The control valve 193 is connected to throttle valves 194 and 195 at the discharge side thereof wherein the throttle valve 194 is connected to a third hydraulic cylinder 150 and the throttle valve 195 is connected to the first hydraulic cylinder 109. The third hydraulic cylinder 150 is housed inside the boom body 113 for telescopically moving the middle and upper booms 110 and 111 together with the mechanism of a chain and the like. The third hydraulic cylinder 150 is connected to the control valve 193 at the discharge side thereof. The outlet side of the first hydraulic cylinder 109 is serially connected to the pressure application side of the second hydraulic cylinder 118 while the discharge side of the second hydraulic cylinder 118 is connected to the control valve 193. The throttle valves 194 and 195 are connected to electromagnetic synchronous valves 196 and 197.

In FIG. 11, designated 198 is a control unit having an operating lever 199 which issues a signal instructing to vertically operate the platform 116 when the operating lever 199 is operated by the operator. A control output from the control unit 198 for raising the platform 116 is connected to an electromagnetic coil for a "normal open position" of the control valve 193 by way of a raising instruction circuit 1000. A control output from the control unit 198 for lowering the platform 116 is connected to an electromagnetic coil for a "backward open position" of the control valve 193 by way of a lowering instruction circuit 1010. An output of the lowering instruction circuit 1010 is also connected to the motor 189 and to switching contacts 1050 and 1060 of a switching device 1040.

An output of the limit switch 184 is connected to a correction circuit 1020. An output of the correction circuit 1020 is connected to the switching contact 1050 of the switching device 1040. The switching device 1040 is a two pole two contact point type electric switch and comprises two switching contacts 1050 and 1060 and four fixed contact points 1070, 1080, 1090 and 1100. The switching contacts 1050 and 1060 interlock. The switching contact 1050 normally contacts the fixed contact point 1070 but can contact the fixed contact point 1080 by switching. The switching contact 1060 normally contacts the fixed contact point 1090 but can contact the fixed contact point 1100 by switching. An output of the limit switch 185 is connected to the correction circuit 1030 and an output of the correction circuit 1030 is connected to the switching contact 1060 of the switching device 1040. The fixed contact points 1070 and 1100 of the switching device 1040 are connected to an electromagnetic coil of the solenoid synchronous valve 197 while the fixed contact points 1080 and 1090 of the switching device 1040 are connected to an electromagnetic coil of the solenoid synchronous valve 196.

The operation of the lifting apparatus, according to the first embodiment of the present invention, will be described hereinafter.

FIGS. 2 and 3 are views showing the states where the telescopic boom body 113 is contracted to thereby lower the platform 116 to its lowest position. At this state, the operator and/or the material are respectively loaded on the platform 116 and the platform 116 is raised. Firstly, to raise the platform 116, the engine 190 provided in the drive box 104 is operated to drive the hydraulic pump 191 so that the oil is sucked from the oil tank 192 to place the oil under pressure. The oil under pressure is supplied from the oil tank 192 to the control valve 193, and thereafter supplied to the first to third hydraulic cylinders 109, 118 and 150 so that the platform 116 is raised or lowered.

When the operator operates to push the operating lever 199 of the control unit 198 to the raising position, the control unit 198 issues the signal which is supplied to the raising instruction circuit 1000. The signal is supplied from the raising instruction circuit 1000 to the "normal open" electromagnetic coil of the control valve 193, whereby the control valve 193 is switched to the "normal open" position. As a result, the oil under pressure from the hydraulic pump 191 is supplied to the third hydraulic cylinder 150 by way of the throttle valve 194 and also supplied to the first hydraulic cylinder 109 by way of the throttle valve 195. The oil under pressure discharged from the first hydraulic cylinder 109 is supplied to the second hydraulic cylinder 118. The oil under pressure discharged from the second hydraulic cylinder 118 is returned to the oil tank 192 by way of the control valve 193. Since the first and second hydraulic cylinders 109 and 118 are serially connected to each other, both the first and second hydraulic cylinders 109 and 118 always elongate at the same rate so that the platform 116 is always kept in parallel with the chassis 101 irrespective of the inclining angle of the telescopic boom body 113 In such a manner, the third hydraulic cylinder 150 and the first and second hydraulic cylinders 109 and 118 are simultaneously operated so that the telescopic boom body 113 is elongated to the entire length thereof and inclined relative to the chassis 101 due to the elongation of the first hydraulic cylinder 109.

When the oil under pressure is supplied to the hydraulic cylinders 109 and 118, the rods of the first and second hydraulic cylinders 109 and 118 respectively move longitudinally whereby the lower boom 106 is turned upward relative to the pin 107. As a result, the telescopic boom body 113 is inclined upwardly gradually, relative to the chassis 101.

When the oil under pressure is supplied to the third hydraulic cylinder 150 by way of the throttle valve 194, the oil under pressure operates to telescopically elongate the telescopic boom body 113. That is, the middle boom 110, which is longitudinally slidable in the lower boom 106, is pulled out from the lower boom 106 while the upper boom 111, which is longitudinally slidable in the middle boom 110, is pulled out from the middle boom so that the distance between the pins 107 and the pin 115 is increased. During the telescopic movement, the rollers 124 contact the upper surface of the lower boom 106 and move lengthwise on the upper surface of the lower boom 106 while rolling thereon.

Inasmuch as there are gaps between the cover body 112 and the lower boom 106, the middle boom 110 and the upper boom 111, play is likely to occur in the gaps whereby the telescopic boom body 113 is liable to be deformed. However, the load of the platform 116 is transmitted to the pin holes 122 by way of the second hydraulic cylinders 118 so that the stress for bending downward is applied to the cover body 112 because the stress is applied on the pin holes 122. Since the rollers 124 roll on the upper surface of the lower boom 106, the load of the platform 116 is supported by the rollers 124 and from thence is transmitted to the lower boom 106, and the cover body 112 is not deformed and moves upwardly together with the upper boom 111.

When the lower boom 106 moves relative to the cover body 112, the upper end of the lower boom 106 passes under the lower surfaces of the rollers 124. However, since the upper end of the upper boom 111 slides so as to move away from the upper end of the middle boom 110 and is pulled out from the middle boom 110 when the telescopic boom body 113 is telescopically moved, the chains 143 are pulled out from the inside of the upper boom 111 and roll on the rail 146 so as to rotate the sprocket wheels 141 and 142. Since the chains 143 slide on the rail 146, the chains 143 move smoothly and at the same time the rollers 144 fixed to the chains 143 are also moved.

Accordingly, the rollers 144 fixed to the chains 143 are also moved together with the upper boom 111 so that each roller 144 moves into the space defined between the upper boom 111 and the cover body 112.

These rollers 144 roll on the inner wall of the cover body 112 while contacting the inner wall so that the load of the platform 116 applied to the cover body 112 is transmitted to the upper end of the upper boom 111 by way of the rollers 144, the chains 143 and the rail 146. Even when the rollers 124 are moved away from the lower boom 106, the cover body 112 is not likely to be deformed by the load applied to the cover body 112 because each roller 144 contacts the inner wall of the cover body 112.

Figure 12:
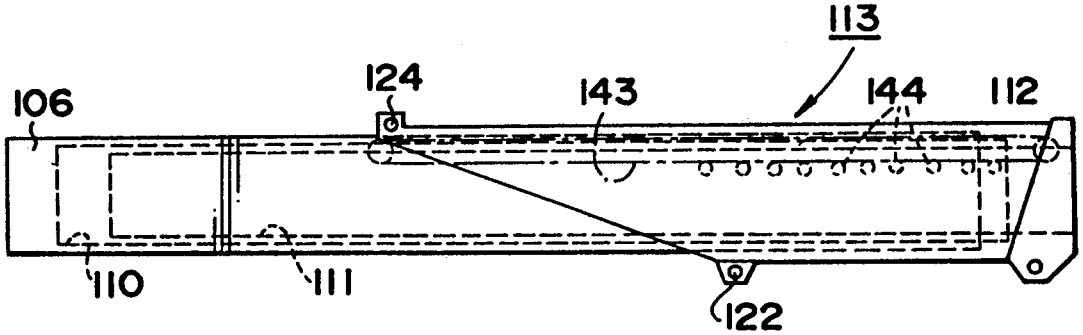
FIG. 12 is a view showing the state where the telescopic boom body is contracted.
Figure 13:
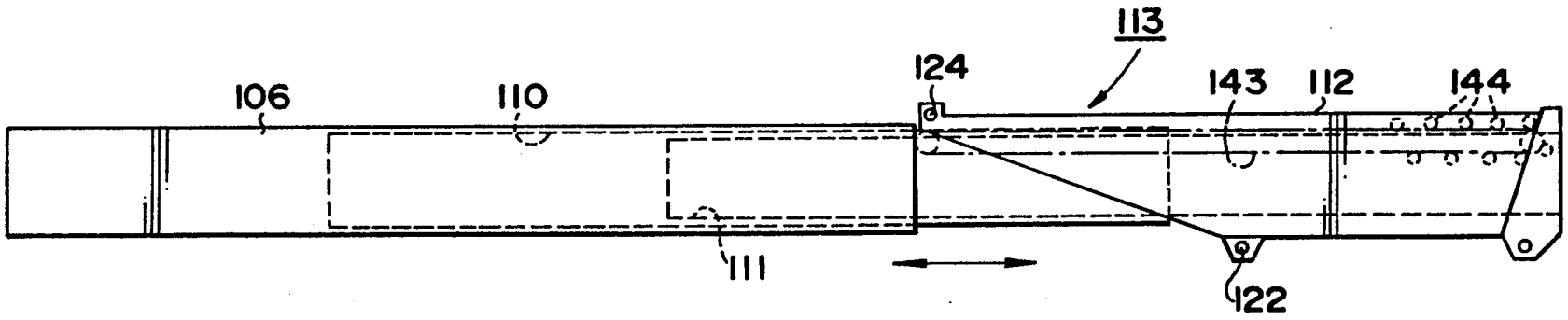
FIG. 13 is a view showing the state where the telescopic boom body is midway through contraction.

FIG. 12 shows the telescopic boom body 113 in a first (retracted) state wherein the load applied to the pin holes 122 is supported by the rollers 124. With further advancement of the telescopic elongating operation of the telescopic boom body 113, the lower boom 106 is pulled out from the cover body 112 so that the rollers 124 are moved away from the upper surface of the lower boom 106 (refer to FIG. 13). At this time, the rollers 144 were already pulled out by the middle boom 110 between the upper boom 111 and the cover body 112 so that the load applied to the pin holes 122 is transmitted to the cover body 112 by way of the rollers 144 and the like, thereby keeping the spacing between the cover body 112 and the upper boom 111 and keeping them in parallel relationship.

Figure 14:
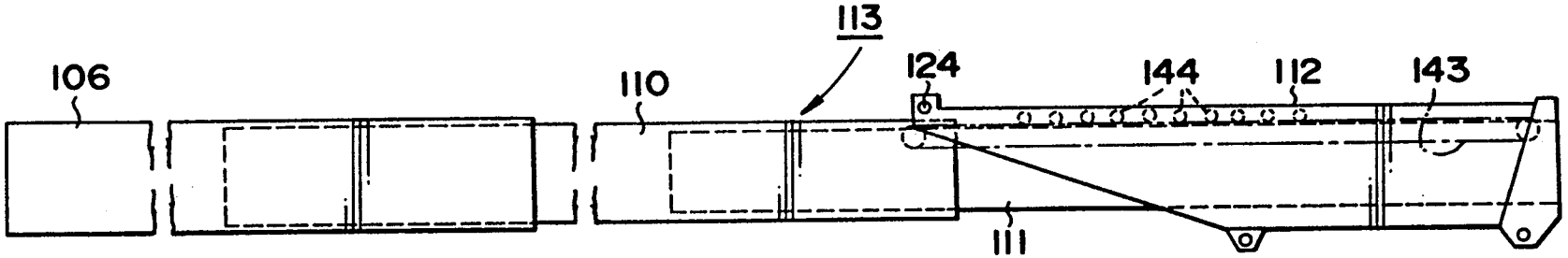
FIG. 14 is a view showing the state where the telescopic boom body is extended.

When the middle boom 110 is pulled out from the lower boom 106, the distance between the tip end of the upper boom 111 and the middle boom 110 is increased so that the rollers 144 are disposed in equal intervals and roll between the upper boom 111 and the cover body 112 as the upper boom 111 is successively pulled out from the middle boom 110 and finally stopped at the state as illustrated in FIG. 14 which shows the maximum elongation position of the telescopic boom body 113. The telescopic boom body 113 can smoothly move telescopically by the contact and rolling support between the telescopic boom body 113 and the rollers 124 and the rollers 144.

When the telescopic boom body 113 is contracted, the telescopic boom body 113 moves in the manner that the upper boom 111 is inserted into the middle boom 110 while the chains 143 move in the opposite direction so that the rollers 144 are accommodated inside the upper boom 111. When the upper end of the lower boom 106 contacts the lower end of the cover body 112, the rollers 124 start to roll on the upper surface of the lower boom 106. As a result, the telescopic boom body 113 operates in the order of states illustrated in FIGS. 14 to 12 so that the load applied to the cover body 112 can be first applied to the rollers 144 and then applied to the rollers 124. Although the rollers 144 serving as spacers are cylindrical according to the present invention, the spacers may be square or polygonal if they fill the space between the cover body 112 and the upper boom 111 and are capable of operating in the same manner as the rollers 144.

As mentioned above, the telescopic boom body 113 is inclined by the first hydraulic cylinders 109 and at the same time it is elongated in the longitudinal direction thereof by the third hydraulic cylinder 150. At this time, since the oil under pressure is supplied to the second hydraulic cylinder 118 in parallel with the first hydraulic cylinder 109, the second hydraulic cylinder 118 elongates in synchronism with the first hydraulic cylinder 109. The second hydraulic cylinder 118 operates to increase the angular spacing between the telescopic boom body 113 and the platform 116. When the elongation amounts of the first and second hydraulic cylinders 109 and 118 become equal to each other, the angular spacing between the chassis 101 and the telescopic boom body 11 becomes equal to the angular spacing between the platform 116 and the telescopic boom body 113. Accordingly, the lifting apparatus is substantially Z-shaped when viewed from the side thereof and the platform 116 is always kept in parallel with the chassis 101 for preventing an operator or material loaded on the platform 116 from dropping off the platform.

When the first, second and third hydraulic cylinders 109, 118 and 150 are cooperatively operated, the telescopic boom body 113 is inclined relative to the chassis 101 and the platform 116 is always maintained in parallel with the chassis 101. However, if the first, second and third hydraulic cylinders 109, 118 and 150 operate arbitrarily, the platform 116 cannot rise vertically relative to the chassis 101 even if it can rise upwardly. As a result, the platform 116 can rise while the height of the platform from the chassis 101 varies at the front and rear portions thereof, which causes the platform 116 to be extremely unstable. If the elongating operation of the first hydraulic cylinder 109 is made first, the telescopic boom body 113 is inclined to the large extent, which causes the telescopic boom body 113 to fall down in the rear direction. If the elongating operation of the third hydraulic cylinder 150 is made first, the elongation amount of the telescopic boom body 113 is increased, the center of gravity moves to the front of the chassis 101, which causes the telescopic boom body 113 to fall down in the forward direction. Accordingly, it is impossible to raise the platform 116 vertically relative to the chassis 101 if the first and second hydraulic cylinders 109 and 118 are not synchronous with the third hydraulic cylinder 150. The synchronization of inclination and the elongation of the telescopic boom body 113 will be described with reference to FIG. 15.

In the case of raising the platform 116, the lever 199 is pushed to the raising position so that the controller 198 supplies a signal to the raising instruction circuit 1000 so that the control valve 193 is switched to the "normal open" position. The oil under pressure in the oil pump 191 is directly supplied to the third hydraulic cylinder 150 so that the telescopic boom body 113 is elongated. At the same time, since the oil under pressure is supplied to the first hydraulic cylinder 109, the first and second hydraulic cylinders 109 and 118 are elongated simultaneously so that the telescopic boom body 113 is inclined upward relative to the chassis 101. In such a manner, the lifting apparatus is formed in a Z-shape when viewed from the side thereof by the chassis 101, the telescopic boom body 113 and the platform 116 raised over the chassis 101.

In case of raising the platform 116 as set forth above, the lever 199 is pushed to the raising position. At this time, the controller 198 supplies the signal to the raising instruction circuit 1000 so that the control valve 193 is shifted to the "normal open" position. As a result, the oil under pressure from the hydraulic pump 191 is supplied to the third hydraulic cylinder 150 to thereby elongate the telescopic boom body 113. At the same time, the oil under pressure is also supplied to the first hydraulic cylinder 109 so that the first and second hydraulic cylinders 109 and 118 are simultaneously elongated. As a result, the telescopic boom body 113 is inclined upward relative to the chassis 101. In this way, the chassis 101, the telescopic boom body 113 and the platform 116 are deformed to be in Z-shape when viewed from the side thereof so that the platform 116 is raised upward over the chassis 101.

Figure 15A:
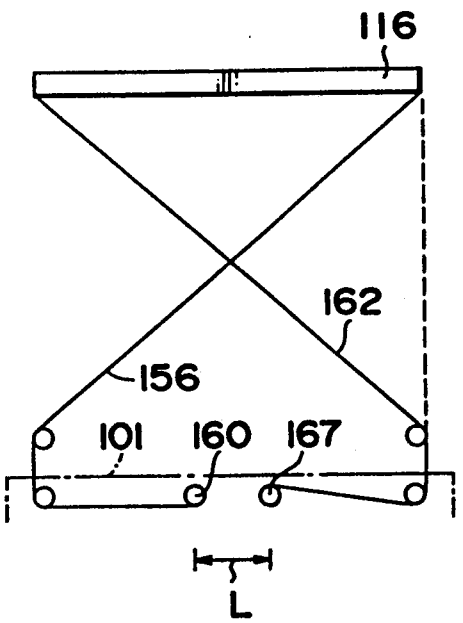
FIG. 15(A), 15(B) and 15(C) are views showing the state where the position of the platform is corrected.

When the platform 116 is raised, the first and second extension wires 156 and 162, which are connected to the first and second wire hangers 156 and 161, are drawn and rollingly moved on the pulleys 157 and 159, 164 and 166 to thereby rotate the winding drums 160 and 167. As a result, the wires 156 and 162 are unwound from the winding drums 160 and 167. If the platform 116 is raised straight relative to the chassis 101, both the extension wires 156 and 162 are stretched in the X-shape. If the elongation amount of the first extension wire 156 is same as that of second extension wire 162, the platform 116 is always vertically raised relative to the chassis 101. This is illustrated in FIG. 15(A) wherein the first and second extension wires 156 and 162 are drawn at the same length and the interval between the first and second winding drums 160 and 167 is L. At this time, the contact plate 183 does not contact the limit switches 84 and 85. If this state is maintained, the platform 116 is vertically raised straight relative to the chassis 101. At this time, since the first and second winding drums 160 and 170 are rotationally interlocked with each other by the sprocket wheels 177 and 178 and the chain 179, both the winding drums 160 and 167 are always rotated at the same speed. As a result, the drawing amount of the first extension wire 156 from the first winding drum 160 always conforms to that of the second extension wire 162 from the second winding drum 167. As evident from this, if the rotating amount of the first winding drum 160 is the same as that of the second winding drum 167, the drawing rate of the first extension wire 156 is always the same as that of the second extension wire 162 so that the interval L between the first and second winding drums 160 and 167 is not varied.

However, at this time, when the elongating operation of the first hydraulic cylinder 109 precedes the elongating operation of the third hydraulic cylinder 150 and the inclining angle of the telescopic boom body 113 is too large for the elongation amount of the telescopic boom body 113, the platform 116 moves while deviating at the other side (leftward in FIG. 15). At this time, although the elongation amount of wire 156 of the first winding drum 160 is differentiated from that of wire 162 of the second winding drum 167, the rotation amount between the drums is the same, as mentioned above. Accordingly, the second winding drum 167 is drawn by the drawing forth of the second extension wire 162 and the shaft 174 is forced to be moved along the long holes 175 and 176 rightward in FIG. 10. As a result, the interval between the first and second winding drums 160 and 167 is varied from L to L+S. Since the second winding drum 167 and the shaft 174 are moved rightward through the distance S, the contact plate 183 inserted into the shaft 174 contacts the limit switch 185 to thereby operate to correct the elongating operation of the preceded first hydraulic cylinder 109.

Figure 15B:
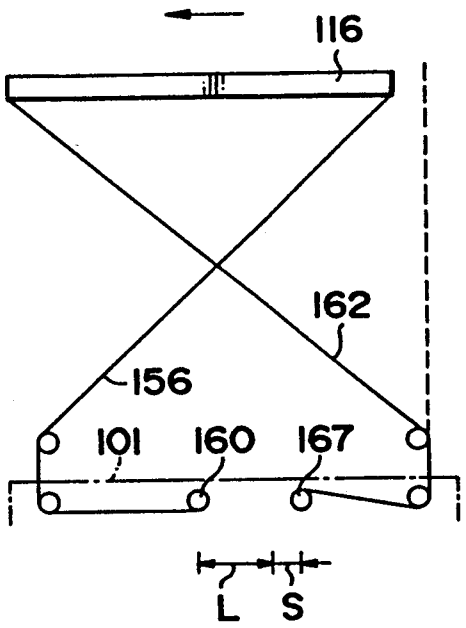

When the contact plate 183 contacts the limit switch 185, the signal from the correction circuit 1030 is supplied to the electromagnetic coil of the solenoid synchronous valve 196 by way of the switching contact 1060 and the fixed contact point 1090. Accordingly, the solenoid synchronous valve 196 is opened to thereby form a bypass circuit outside the throttle valve 194 so that the oil under pressure from the hydraulic pump 191 is directly supplied to the third hydraulic cylinder 150 without passing the throttle valve 194. The amount of oil under pressure supplied to the third hydraulic cylinder 150 is larger than that supplied to the first hydraulic cylinder 109 so that the elongation speed of the third hydraulic cylinder 150 is faster than that of the first hydraulic cylinder 109. Accordingly, elongation speed of the telescopic boom body 113 by the third hydraulic cylinder is faster than the inclining speed of the telescopic boom body 113 by the first hydraulic cylinder 109, so that the platform 116 is corrected so as to move horizontally rightward in FIG. 15. When the first extension wire 156 is drawn and equals to the drawing length of the second extension wire 162, the second winding drum 167 moves leftward along the long holes 175 and 176 in FIG. 10 and returns so as to cancel the deviating amount S since the rotating speed of the first winding drum 160 is the same as that of the second winding drum 167. When the platform 116 changes from the state as illustrated in FIG. 15(B) to the state as illustrated in FIG. 15(A), the contact plate 183 is moved away from the limit switch 185 to thereby close the solenoid synchronous valve 196 so that the oil under pressure is supplied to the third hydraulic cylinder 150 by way of the throttle valve 194.

Figure 15C:
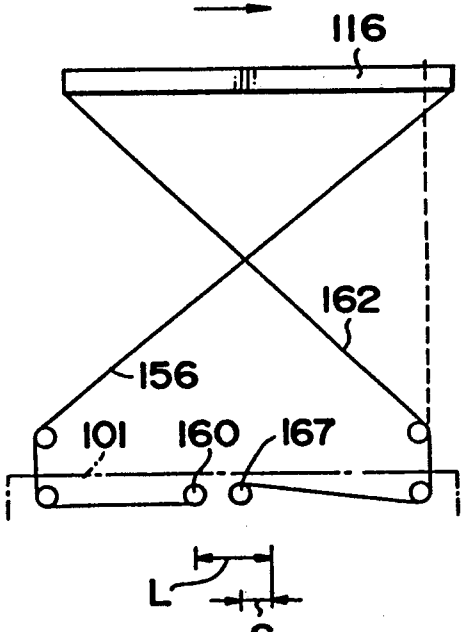

When the elongating speed of the third hydraulic cylinder 150, during the elongating and inclining operations of the telescopic boom body 113, is faster than that of the first hydraulic cylinder 109, the platform 116 moves horizontally in the direction of one side of the chassis 101 (rightward in FIG. 15(C)) so that the first extension wire 156 is drawn out longer than the second extension wire 162. Inasmuch as the rotating speed of the first winding drum 160 is same as that of the second winding drum 167, the shaft 174 is forced to move along the long holes 175 and 176 in the leftward direction in FIG. 10. Accordingly, the interval between the first and second winding drums is decreased by the moving length S from the normal interval L, i.e. L−S. At this time, the contact plate 183 contacts the limit switch 184, to thereby instruct that the platform 116 is deviated at one end of the chassis 101.

When the limit switch 184 is operated, the signal from the correction circuit 1020 is supplied to the electromagnetic coil of the solenoid synchronous valve 197 by way of the switching contact 1050 and the fixed contact point 1070. Accordingly, the solenoid synchronous valve 197 is opened to thereby form a bypass circuit outside the throttle valve 195 so that the oil under pressure from the hydraulic pump 191 is directly supplied to the first hydraulic cylinder 109 without passing the throttle valve 195. The amount of oil under pressure supplied to the first hydraulic cylinder 109 is larger than that supplied to the third hydraulic cylinder 150 so that the elongating speed of the first hydraulic cylinder 109 is faster than that of the third hydraulic cylinder 150. Accordingly, inclining speed of the telescopic boom body 113 by the first hydraulic cylinder 109 is faster than the elongating speed of the telescopic boom body 113 by the third hydraulic cylinder 150, so that the platform 116 is corrected so as to move horizontally leftward in FIG. 15. When the second extension wire 162 is drawn and equals to the drawing length of the first extension wire 156, the second winding drum 167 moves rightward along the long holes 175 and 176 in FIG. 10 and returns so as to cancel the deviating amount S since the rotating speed of the first winding drum 160 is the same as that of the second winding drum 167. When the platform 116 changes from the state as illustrated in FIG. 15(C) to the state as illustrated in FIG. 15(A), the contact plate 183 is moved away from the limit switch 184 to thereby close the solenoid synchronous valve 197 so that the oil under pressure is supplied to the first hydraulic cylinder 109 by way of the throttle valve 195.

A horizontal deviation amount of the second winding drum 167 is detected by the contact plate 183 and the limit switches 184 and 185 to thereby always keep the spacing between the first and second winding drums 160 and 167 near the predetermined amount L so that the platform 116 is always vertically raised with respect to the chassis 101. The deviation of the winding drum 167 equals to the horizontal deviation of the platform 116 with respect to the chassis 101. The synchronous valves 196 and 197 are controlled after detection of this deviation so that the platform 116 is raised vertically with respect to the chassis 101. In another point of view, the elongating speed of the first and third hydraulic cylinders 109 and 150 are alternately controlled in order to keep the lengths of two extension wires 156 and 162 the same with each other so that they always form an X-shape, whereby the platform 116 can be controlled to be raised linearly vertically.

When the platform 116 is raised to the predetermined height, the lever 199 is returned to the "middle" position so that the control valve 193 is closed. As a result, the oil under pressure is not supplied to the first, second and third hydraulic cylinders 109, 118 and 150 so that the platform 116 is kept positioned and stopped at that height.

When the platform 116 is lowered, the platform 116 should be always lowered linearly vertically with respect to the chassis 101. If the contracting speed of the telescopic boom body 113 is increased or the inclining speed is increased, the center of gravity of the platform 116 is deviated at one side or the other side of the chassis 101, whereby the platform 116 is liable to fall down.

When the lever 199 is operated to lower the telescopic boom body 113, a signal issued by the lever 199 is supplied from the control unit 198 to the lowering instruction circuit 1010. The lowering instruction circuit 1010 issues a signal which is supplied to the electromagnetic coil for the "backward open" position of the control valve 193 to thereby reversely open the control valve 193. Accordingly, the oil under pressure from the oil pump 191 is supplied to the second and third hydraulic cylinders 118 and 150 to thereby contract the first, second and third hydraulic cylinders 109, 118 and 150. The signal issued by the lowering instruction circuit 1010 is also supplied to the motor 189 and the switching device 1040. The motor 189 is operated to urge the first winding drum 160 in the counterclockwise direction in FIG. 10 by way of the sprocket wheel 188, the chain 187, the sprocket wheel 186 and the shaft 172 so that the first extension wire 156 is wound by the first winding drum 160. The rotation of the shaft 172 is transmitted to the second winding drum 167 by way of the sprocket wheel 177, the chain 179, the sprocket wheel 178 and the shaft 174, whereby the second winding drum 167 is tuned with the rotating speed of the first winding drum 160 so that the second winding drum 167 is driven thereby. Accordingly, the winding speed of the first winding drum 160 for winding the first extension wire 156 is the same as that of the second winding drum 167 for winding the second extension wire 162. The signal from circuit 1010 causes the switching contact 1050 in the switching device 1040 to contact the fixed contact point 1080, and causes the switching contact 1060 to contact the fixed contact point 1100.

Since the control valve 193 is selected at the "backward open" position, the third hydraulic cylinder 150 is operated to contract the length thereof and the telescopic boom body 113 is contracted. When the first and second hydraulic cylinders 109 and 118 are contracted, the platform 116 is swung so as to reduce the inclination angle of the telescopic boom body 113 while it is kept horizontal. In this case, when the first hydraulic cylinder 109 is contracted, the lower boom 106 turns about the pin 107 so that the lower boom 106 is turned clockwise in FIGS. 1 and 4 whereby the telescopic boom body 113 approaches the horizon.

In this operation, the two extension wires 156 and 162 should always have the same length so that the platform 116 is lowered vertically downward with respect to the chassis 101. Although the retraction of the extension wires 156 and 162 per se is not different from the aforementioned drawing operation, the winding drum 160 draws the extension wire 156 at the appropriate tension since the shaft 172 is turned by the operation of the motor 189 by way of the sprocket wheel 188, the chain 187 and the sprocket wheel 186. Accompanied by the turning of the shaft 172, the shaft 174 is also simultaneously turned by way of the sprocket wheel 177, the chain 179 and the sprocket wheel 178 so that the second winding drum 167 always winds the second extension wire 162 so as to draw at the appropriate tension. In such a manner, the two extension wires 156 and 162 are always stretched to form the X-shape.

Figure 16:
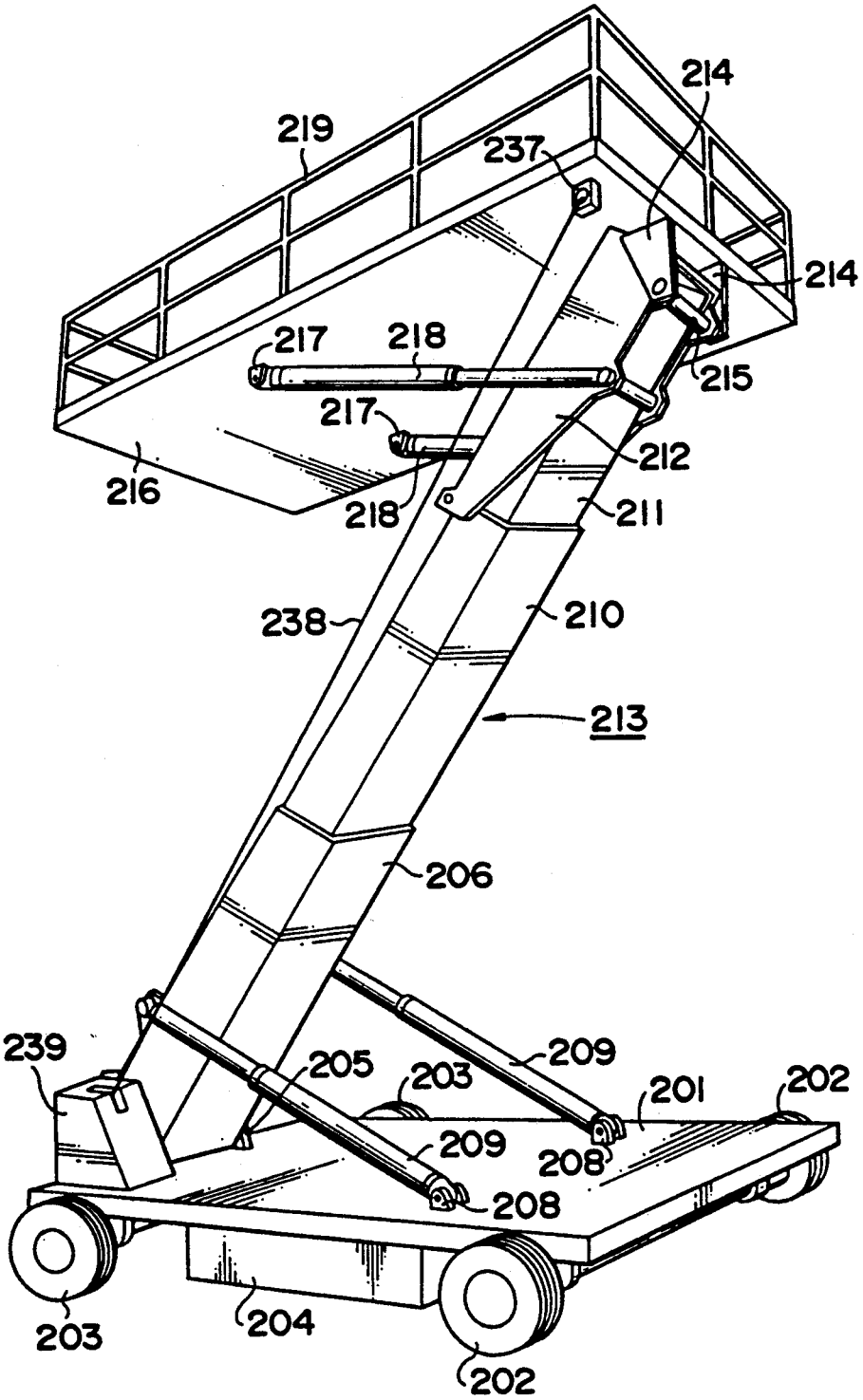
FIG. 16 is a perspective view showing a state wherein a platform, one of the components of the lifting apparatus according to a second embodiment of the present invention, is at its maximum height.

At this state, if the contracting speed of the third hydraulic cylinder 150 is increased, the contracting speed of the telescopic boom body 113 is faster than the inclining speed of the same by the first hydraulic cylinder 109, the platform 116 is moved leftward in FIG. 16 and the first extension wire 156 is more wound (i.e. more slacked) than the second extension wire 162 so that the stretching length of the first extension wire 156 is differentiated from that of the second extension wire 162. Accordingly, as illustrated in FIG. 15(B) and FIG. 10, the shaft of the second winding drum 167 is moved along the long holes 175 and 176 so that the interval between both the winding drums 160 and 167 becomes L+S. At this time, the contact plate 183 on the shaft 174 operates the limit switch 185 to thereby supply the signal to the correction circuit 1030. An output signal from the correction circuit 1030 is supplied to the tuning valve 197 by way of the switching contact 1060 and the fixed contact point 1100 to thereby open the tuning valve 197. As a result, a bypass circuit is formed in parallel with the throttle valve 195, whereby the oil under pressure flows directly to and from the first and second hydraulic cylinders 109 and 118 so that the contracting speed thereof is expedited. When the contracting speed of the first hydraulic cylinder 109 is expedited, the inclination angle of the telescopic boom body 113 is sharply reduced. As a result, the platform 116 is forced to be moved toward one side of the chassis 101 (rightward in FIG. 15) and returned to the state as illustrated in FIG. 15(A). At this time, the second extension wire 162 is more wound (i.e. more slacked) than the first extension wire 156. Since the turning rate of the first winding drum 160 is the same as that of the second winding drum 167, the shaft 174 of the second winding drum 167 is moved along the long holes 175 and 176 toward the first winding drum 160. The contact plate 183 is moved away from the limit switch 185 so that the signal from the correction circuit 1030 is stopped to thereby close the tuning valve 197. Accordingly, the oil under pressure returns from the first and second hydraulic cylinders 109 and 118 through the throttle valve 195 so that the contracting speed is reduced.

In case that the contracting speed of the first and second hydraulic cylinders 109 and 118 is faster but the contracting speed of the third hydraulic cylinder 150 is slow, the platform 116 is moved horizontally in the direction of another side of the chassis 101, as illustrated in FIG. 15(C). At this state, the stretched length of the first extension wire 156 is longer than that of the second extension wire 162 (i.e. the wire 162 is more slacked). Since the turning speed of the second winding drum 167 on which the second extension wire 162 is wound is the same as that of the first winding drum 160 on which the first extension wire 156 is wound, the shaft 174 supporting the second extension wire 167 is moved along the long holes 175 and 176 toward the first winding drum 160. As a result, the interval between the first and second winding drum is shortened to become L−S so that the contact plate 183 contacts the limit switch 184. When the limit switch 184 operates, the signal issued by the correction circuit 1020 is supplied to the electromagnetic coil of the tuning valve 196 by way of the switching contact 1050 and the fixed contact point 1080 to open the tuning valve 196. Accordingly, a bypass circuit is formed in parallel with the throttle valve 194 so that the flow of oil under pressure to and from the third hydraulic cylinder 150 is more expedited, which causes the contracting speed of the third hydraulic cylinder 150 to expedite. Accordingly, the speed to contract the length of the telescopic boom body 113 is expedited so that the platform 116 is forced to be moved horizontally leftward in FIG. 15 and returned to the normal state as illustrated in FIG. 15(A). When the length of the telescopic boom body 113 is contracted quickly, the drawing speed of the first extension wire 156 is expedited and corrected to approach the length of the second extension wire 162. As a result, the interval between the two winding drums 160 and 167 is lengthened and returned to the original length, i.e. L so that the contact plate 183 is moved away from the limit switch 184 and the signal issued by the correction circuit 1020 is removed from the tuning valve 196 to thereby close the tuning valve 196. At this time, the flow amount of oil under pressure supplied from the hydraulic pump 191 to the third hydraulic cylinder 150 equals that which passes the throttle valve 194 so that the contracting speed of the third hydraulic cylinder 150 is reduced.

In such a manner, the contact plate 183 alternately contacts the limit switches 184 and 185 to thereby control two tuning valves 196 and 197, whereby the stretching lengths of the first and second extension wires 156 and 162 are corrected to be always the same. As a result, the tip end of the telescopic boom body 113 lowers vertically linearly with respect to the chassis 101 so that the platform 116 is lowered straight downward while it is kept horizontal.

With such an arrangement, the inclining means and telescopical moving means can correct the platform with respect to the chassis by detecting the stretching deviation of two wires which are stretched in the X-shape between the platform and the chassis. Although the deviation detecting means is simply structured, it is possible to raise or lower the platform vertically with respect to the chassis. If the control for vertically moving the platform with respect to the chassis is made using instruments such as a computer and high priced angle detecting and elongation detecting sensors, the entire apparatus is expensive. However, it is possible to manufacture the lifting apparatus having the control function of the present invention at extremely low cost.

A lifting apparatus according to a second embodiment of the present invention will be described hereinafter with reference to FIGS. 16 to 33.

The basic arrangement of the second embodiment is substantially the same as that of the first embodiment. Accordingly, described hereinafter are components which are different from those of the first embodiment. However, different numerals are given to the same components as those of the first embodiment for easy understanding of the second embodiment.

Figure 17:
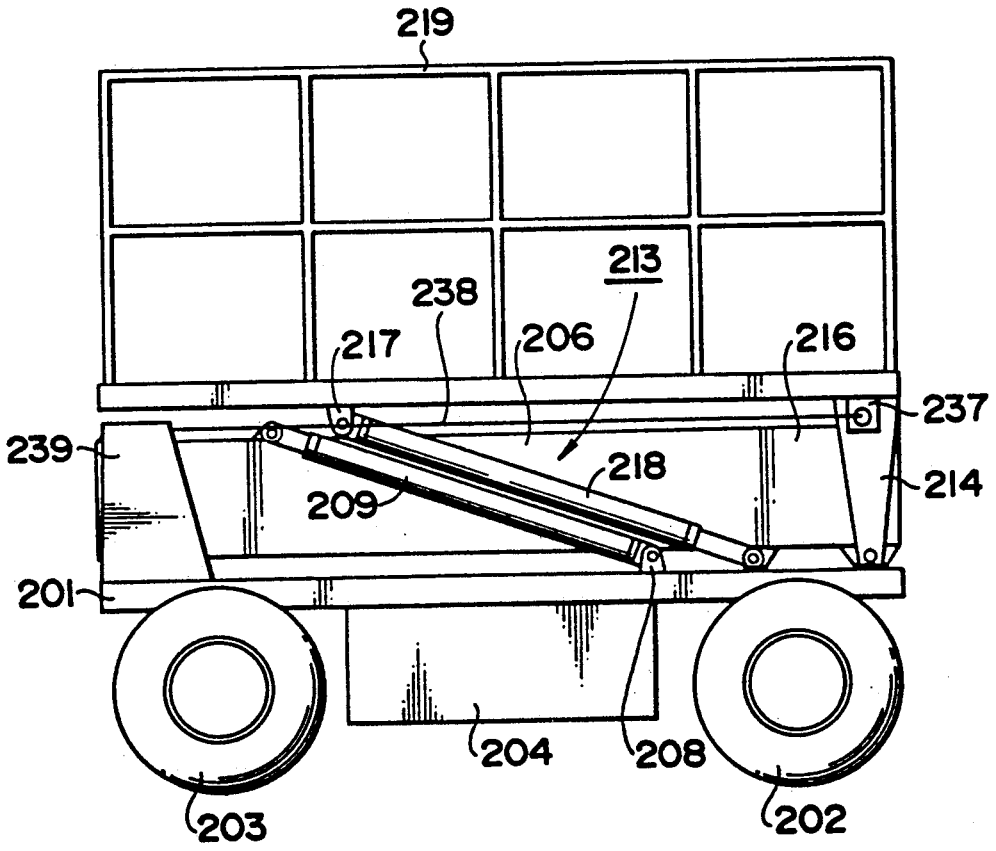
FIG. 17 is a side view showing a state wherein the platform is at its lowest position.
Figure 19:
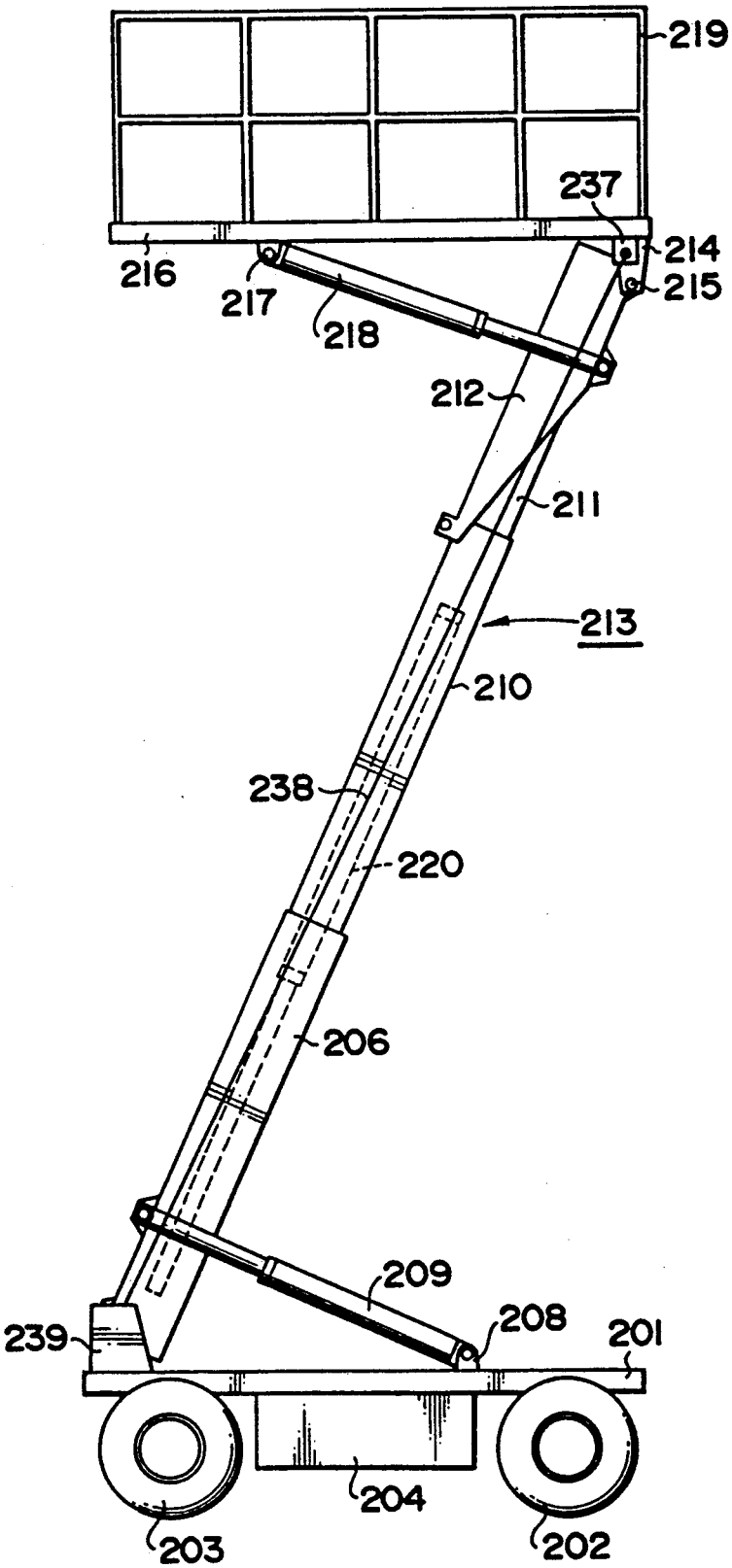
FIG. 19 is a side view showing a state wherein the platform is raised to its maximum height.
Figure 20:
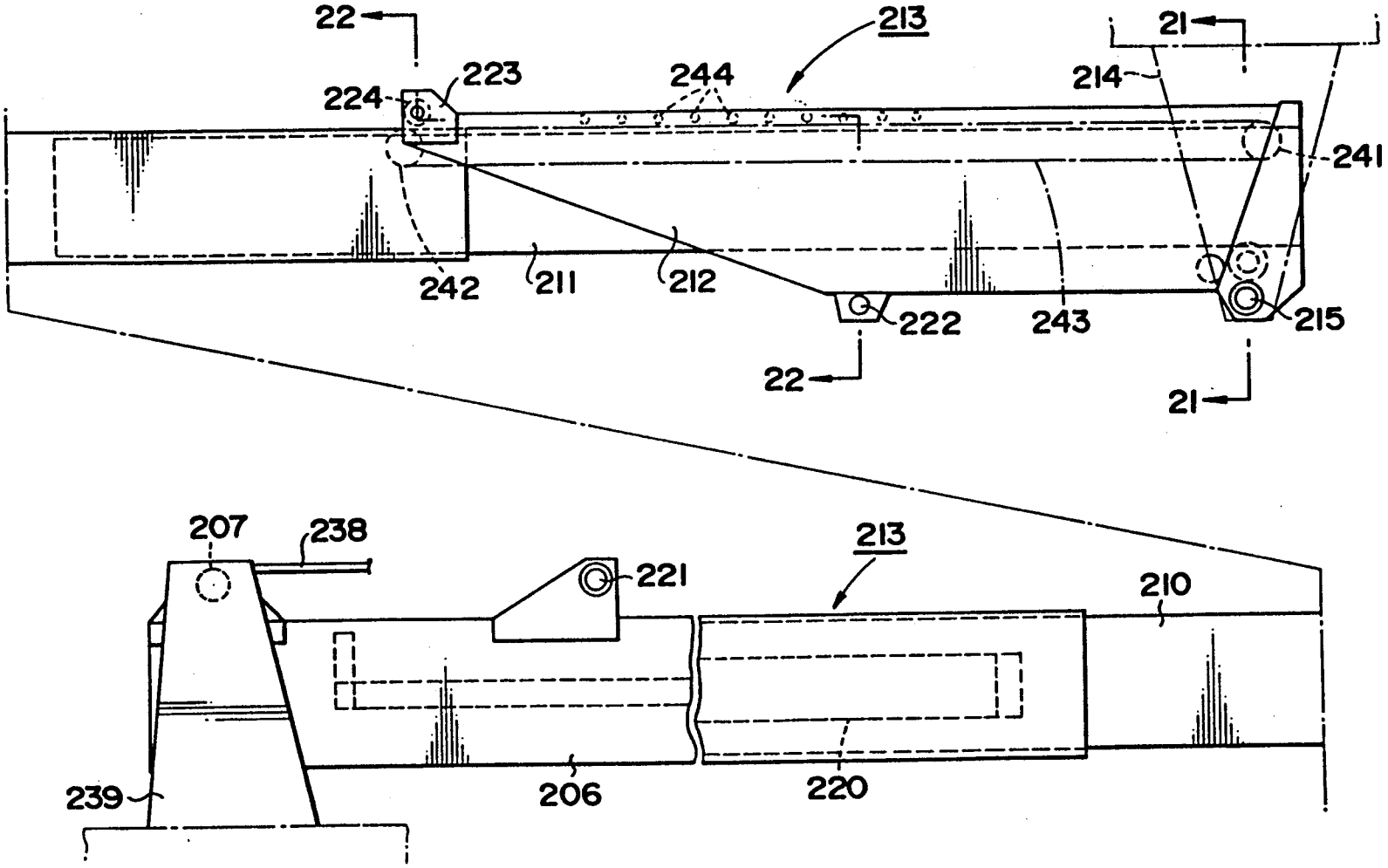
FIG. 20 is a schematic side view showing the internal structure of the telescopic boom body.
Figure 21:
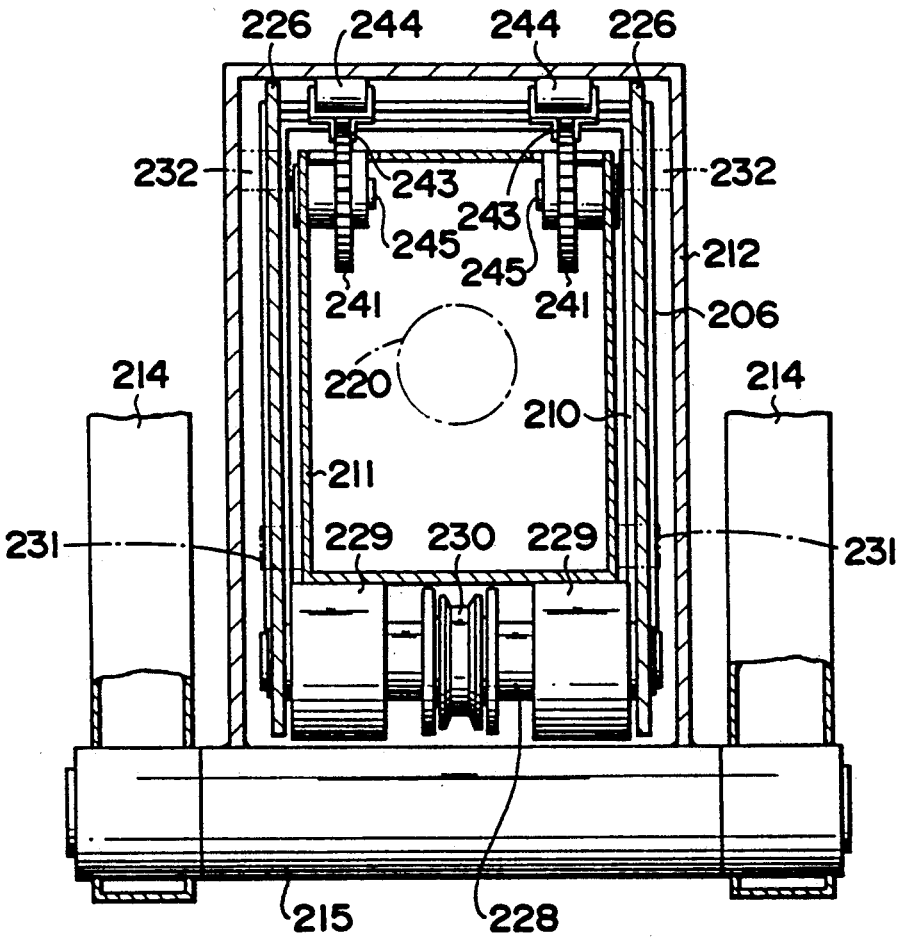
FIG. 21 is a cross-sectional view taken along the cutting line 21—21 in FIG. 20 and showing the telescopic boom body in its extended position.
Figure 22:
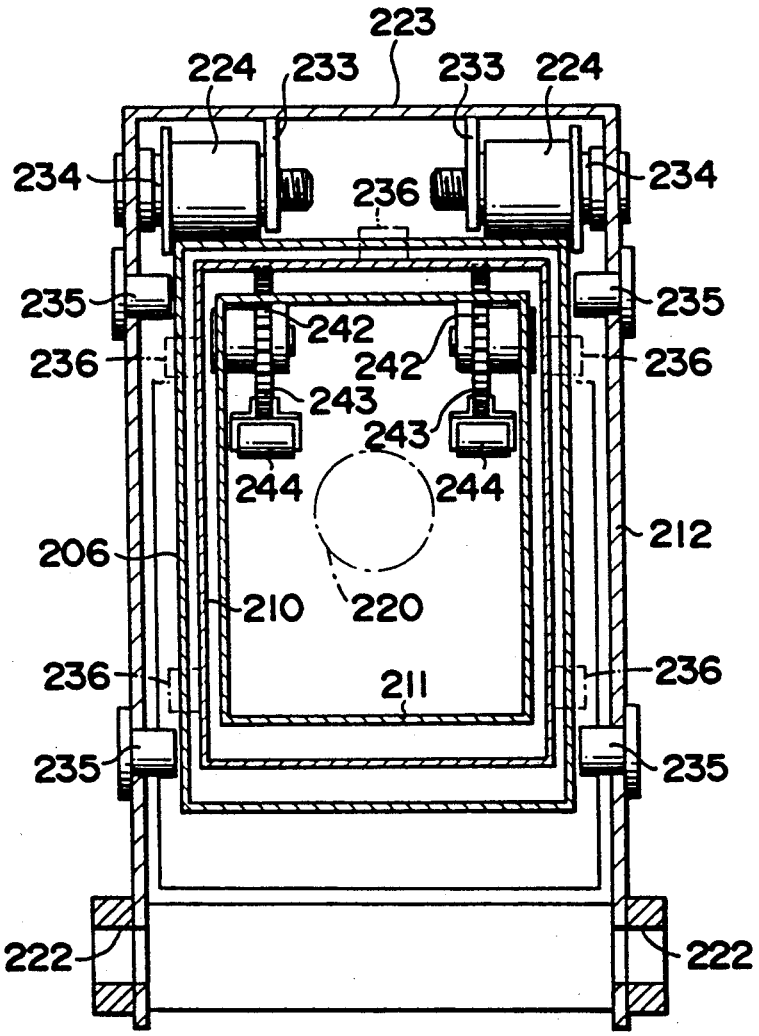
FIG. 22 is a cross-sectional view taken along the cutting line 22—22 in FIG. 20 and showing the telescopic boom body in its contracted position.
Figure 23:
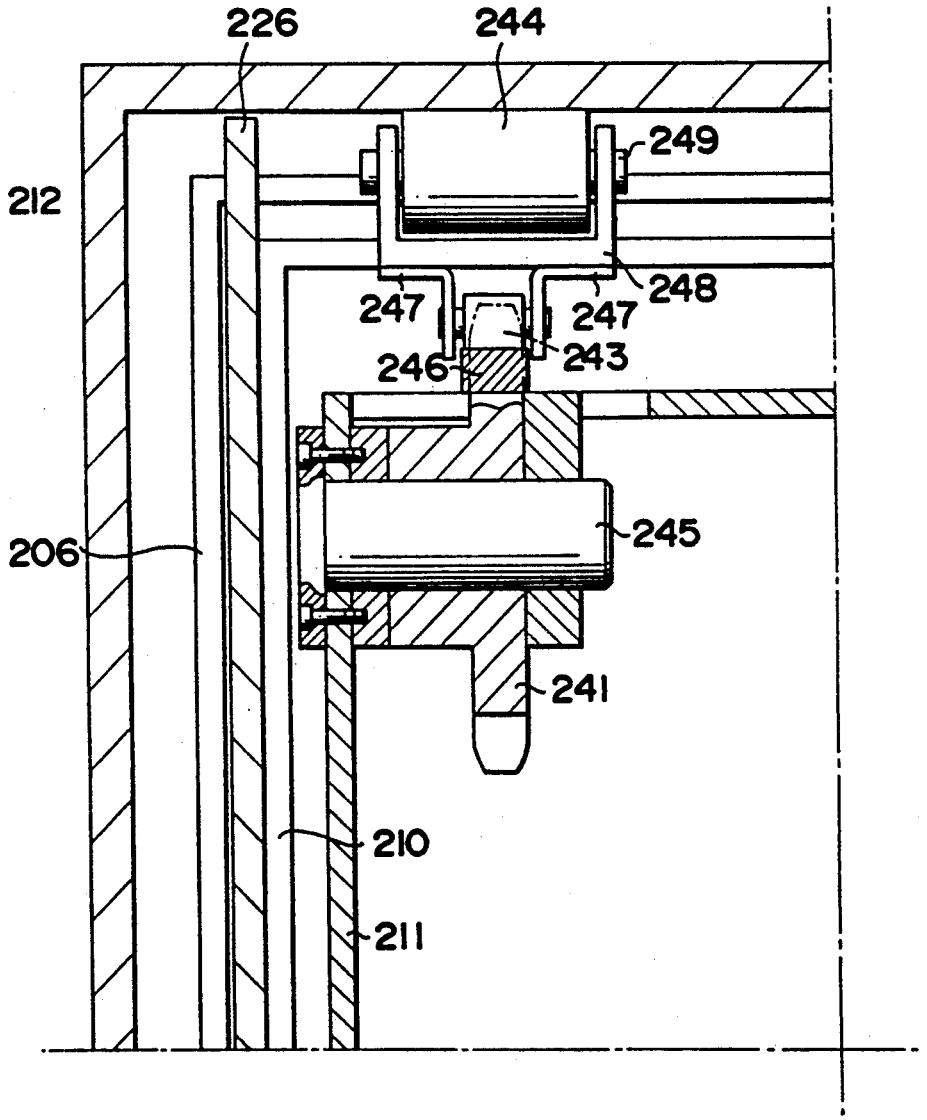
FIG. 23 is an enlarged, cross-sectional view of a fragment of FIG. 21 and showing a portion close to the rollers provided on the upper boom.
Figure 24:
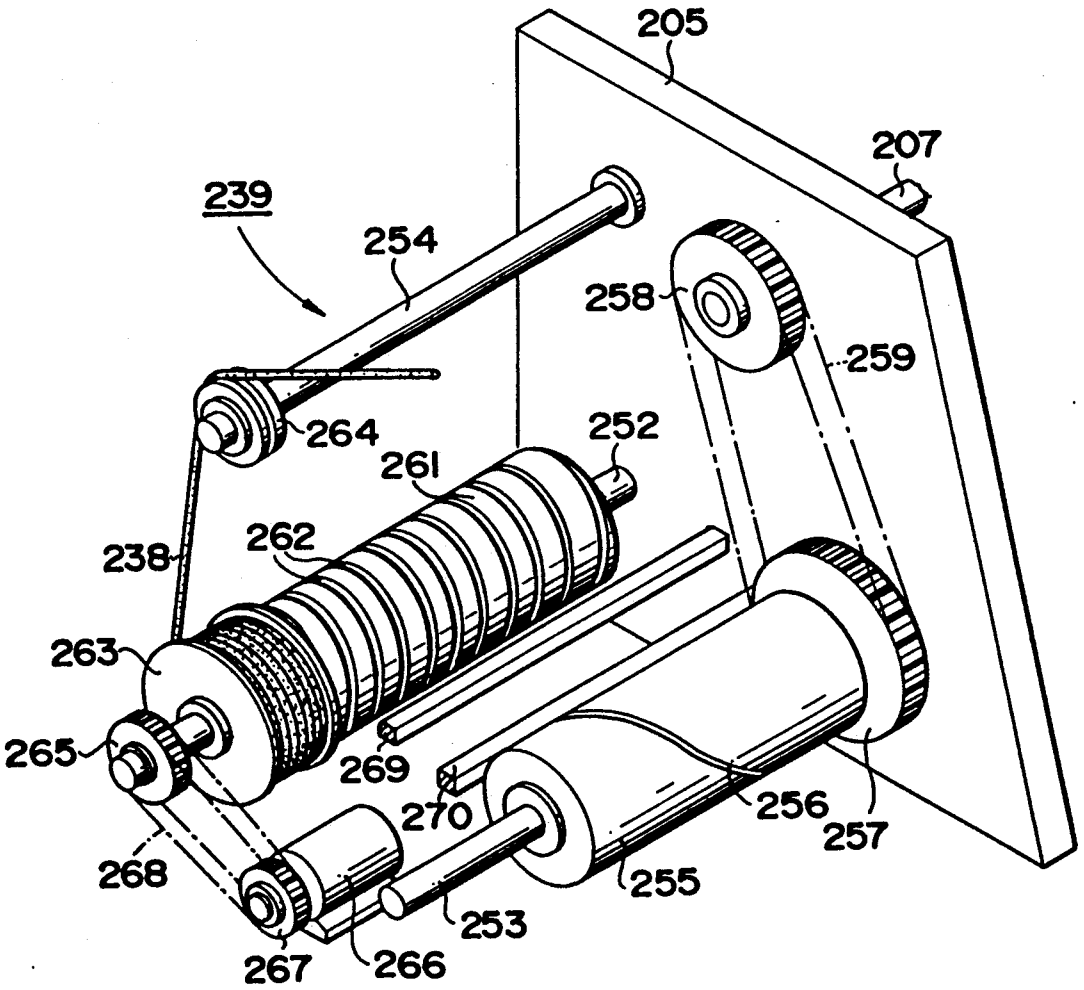
FIG. 24 is a perspective view showing an arrangement of a tuning device, one of the components of the lifting apparatus according to the second embodiment.

A wire hanger 237 is fixed to the lower surface of the platform 216 at a location close to shaft supporting pieces 214 (right side in FIGS. 16, 17 and 19). A detection wire 238, which is composed of a plurality of flexible twisted metal wires, has one end connected to the wire hanger 237 and extends downward along the inclined slope of telescopic boom body 213 to a tuning device 239 provided at the lower side surface of a lower boom 206. Accordingly, the detection wire 238 stretches in parallel with the telescopic boom body 213 so that it is unwound from the tuning device 239 or wound on the tuning device 239 accompanied by the elongating motion of the telescopic boom body 213. The tuning device 239 has therein a winding mechanism for winding the detection wire 238 in a given tension wherein the detection wire 238 is always stretched in the given tension.

Described in detail with reference to FIGS. 24 to 28 is an internal arrangement of the tuning device 239 for synchronizing the elongating operation of the telescopic boom body 213 with the inclining operation of the telescopic boom body 213.

A pair of supporting brackets 205 (FIGS. 16 and 18) are fixedly mounted on the upper surface of the chassis 201 at one side thereof and are pivotally connected with the lower boom 206 by a pin 207 which is fixed to the lower end of the lower boom 206. The supporting bracket 205 supports the lower boom 206 and constitutes a part of an outer shell of the tuning device 239. A supporting bracket 251 is spaced from the supporting bracket 205 in a parallel relation therewith (refer to FIG. 25). Various mechanisms of the tuning device 239 are supported by the supporting brackets 205 and 251. Since the pin 207 is fixed to the lower boom 206, the pin 207 is turned as the lower boom 206 is swung by a first hydraulic cylinder 209.

Synchronous shafts 252 and 253 are turnably supported by the supporting brackets 205 and 251 and a supporting shaft 254 is supported by the supporting brackets 205 and 251 over the synchronous shaft 252. A cylindrical connection cam body 255 is fixed to the central portion of the synchronous shaft 253 and has an outer periphery provided with a cam groove which is defined by cutting the peripheral surface thereof. A gear 257 is fixed to one end of the synchronous shaft 253. The gear 257 and the connection cam body 255 can be turned together with the synchronous shaft 253. A gear 258 is fixed to the pin 207 and a chain 259 is entrained around the gears 257 and 258. A cylindrical proportional cam body 261 and a winding drum 263 are fixed to the synchronous shaft 252. The proportional cam body 261 has an outer periphery provided with a cam groove 262 which is defined by cutting the peripheral surface thereof at given pitches. A pulley 264 is turnably journaled on the supporting shaft 254. The detection wire 238 contacts the pulley 264 and is wound around the winding drum 263. A gear 265 is fixed to one end of the synchronous shaft 252 and disposed outside the supporting bracket 251. A gear 267 is fixed to a rotary shaft of a motor 266 provided between the synchronous shafts 252 and 253. A chain 268 is entrained around the gears 265 and 267.

Figure 25:
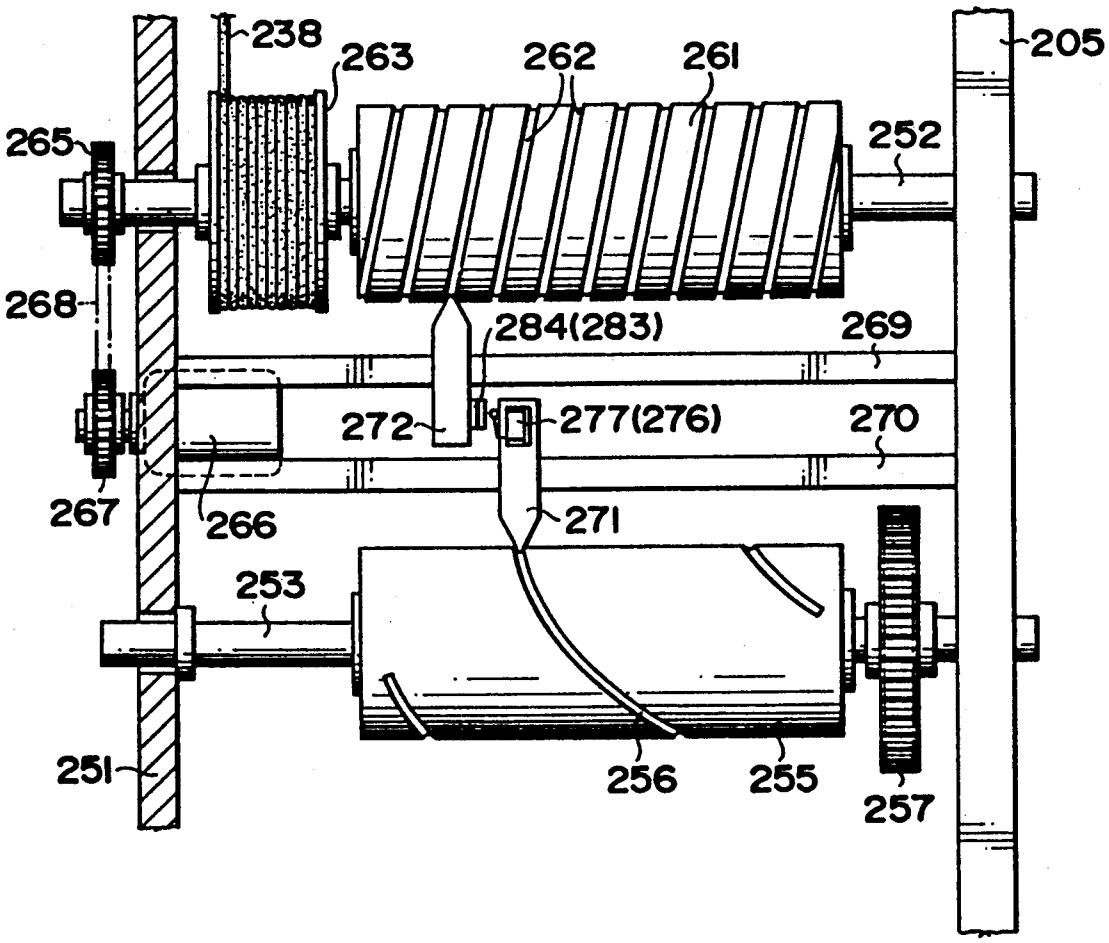
FIG. 25 is a plan view of the tuning device of FIG. 24.

Guide rails 269 and 270 are disposed in parallel with each other between the supporting shafts 252 and 253. The guide rails 269 and 270 are long and of square cross-sections. The guide rails 269 and 270 are disposed in the spaced interval so as not to contact the outer periphery of the correction cam 255 and the outer periphery of the proportional cam body 261. A slider 272 is slidably mounted on the guide rail 269 while a slider 271 is slidably mounted on the guide rail 270, as illustrated in FIGS. 25 and 26.

Figure 26:
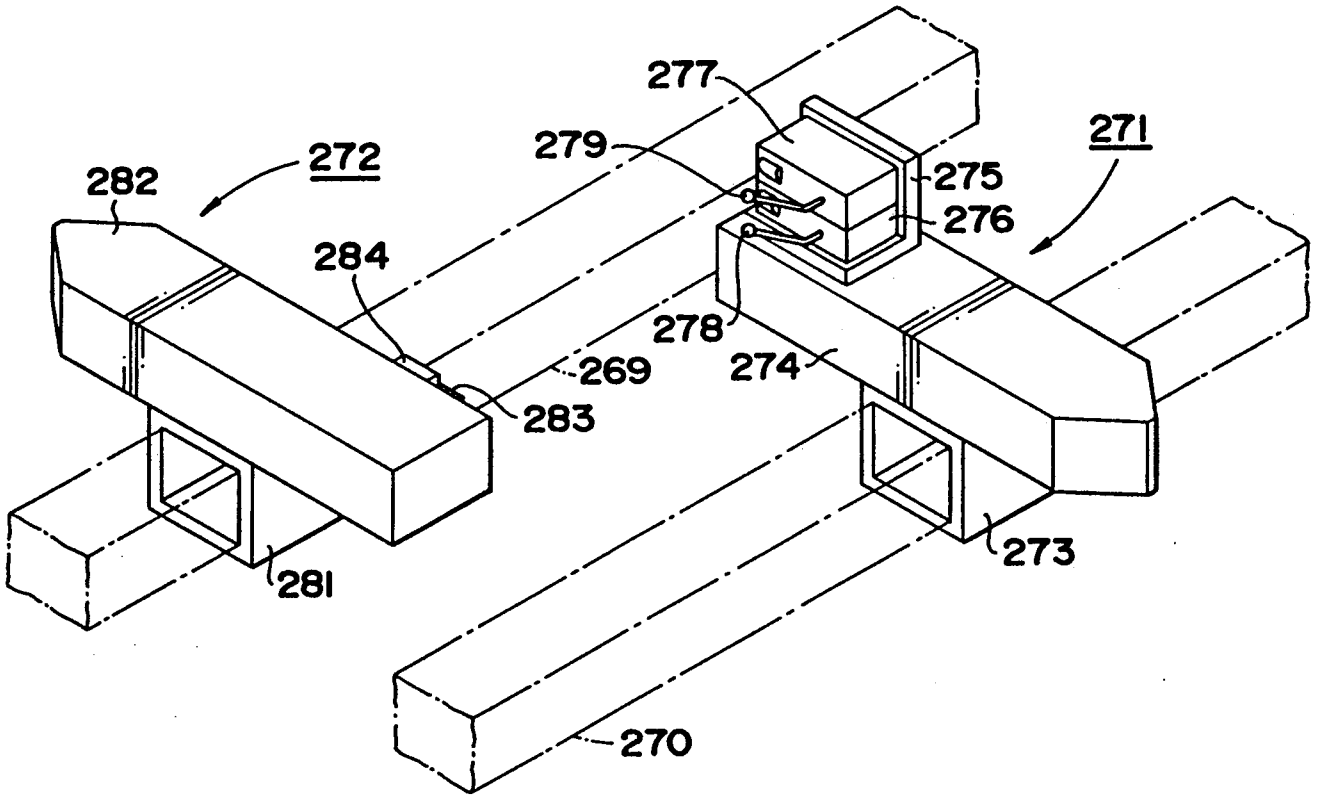
FIG. 26 is a perspective view showing a portion close to a slider of FIG. 24.
Figure 27:
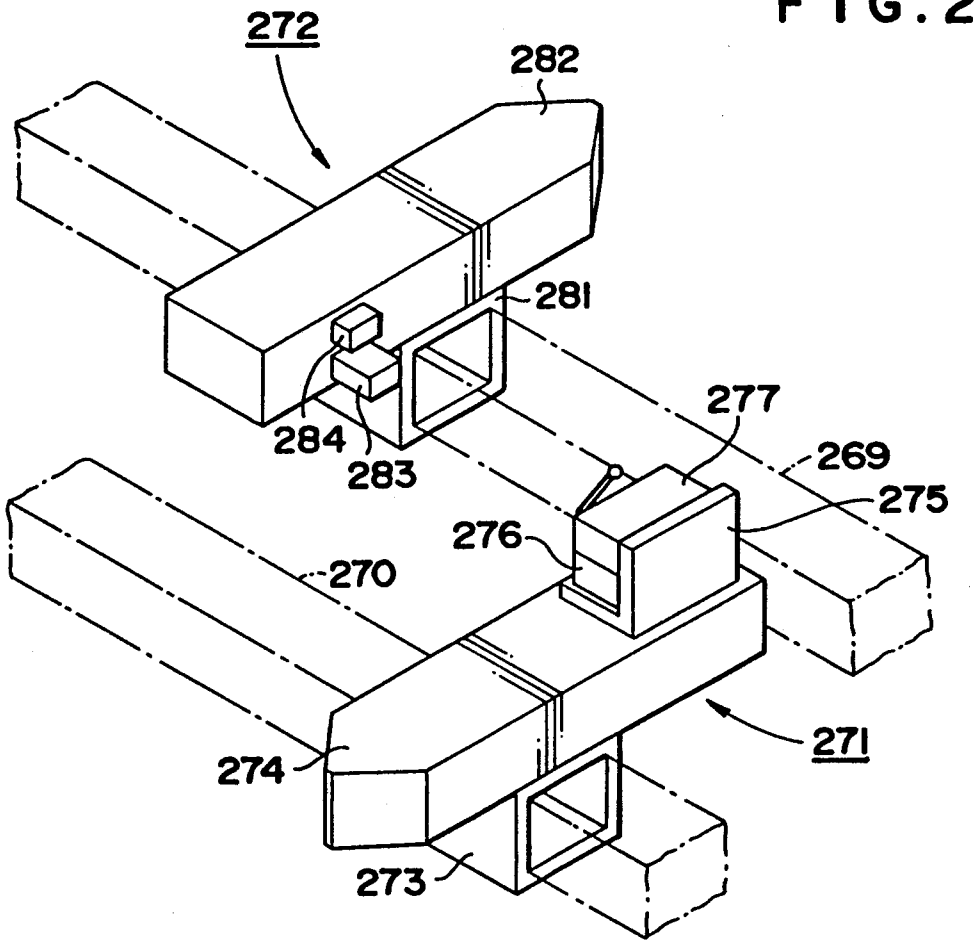
FIG. 27 is a perspective view showing a portion close to the slider of FIG. 24 when viewed from another aspect.

FIG. 26 is an enlarged view showing an arrangement of a combination of the guide rail 269 and the slider 271 and FIG. 27 is an enlarged view showing an arrangement of a combination of the guide rail 270 and the slider 272 in which FIG. 27 is viewed from opposite side of FIG. 26.

The slider 271 has a guide body 273 at the central portion thereof which is of a square cross section and is slidably carried on the guide rail 270. The slider 271 can move in the longitudinal direction of the guide rail 270 by the guide body 273. Placed on the upper surface of the guide body 273 is a long contact body 274 which has a wedge-bracket 275 on the upper surface thereof. The angle bracket 275 has microswitches 276 and 277 at the lower and upper portions thereof. The microswitches 276 and 277 have operative contact members 278 and 279 which are respectively directed to the slider 272. The slider 272 has a guide body 281 which has a square cross section and is slidably carried on the guide rail 269. Placed on the upper surface of the guide body 281 is a contact body 282 having a wedge-shaped tip end. Block-shaped pressing members 283 and 284 are fixed to the lower and upper portions of the side surface of the contact body 282 which is confronted with the slider 271.

The contact bodies 274 and 282 have wedge-shaped tip ends which are directed opposite to each other. The tip end of the contact body 274 is engaged with the cam groove 256 while the tip end of the contact body 282 is engaged with the cam groove 262. The contact bodies 274 and 282 are disposed in parallel with each other and are directed perpendicularly relative to the guide rails 269 and 270. The contact bodies 274 and 282 are alternately disposed so as to contact each other at the rear portions thereof. The side surface of the pressing member 283 is positioned to contact the operative contact member 278 while the side surface of the pressing member 284 is positioned to contact to the operative contact member 279. The pressing member 283 projects further outwardly than the pressing member 284, namely, the former is longer than the latter.

Figure 28:
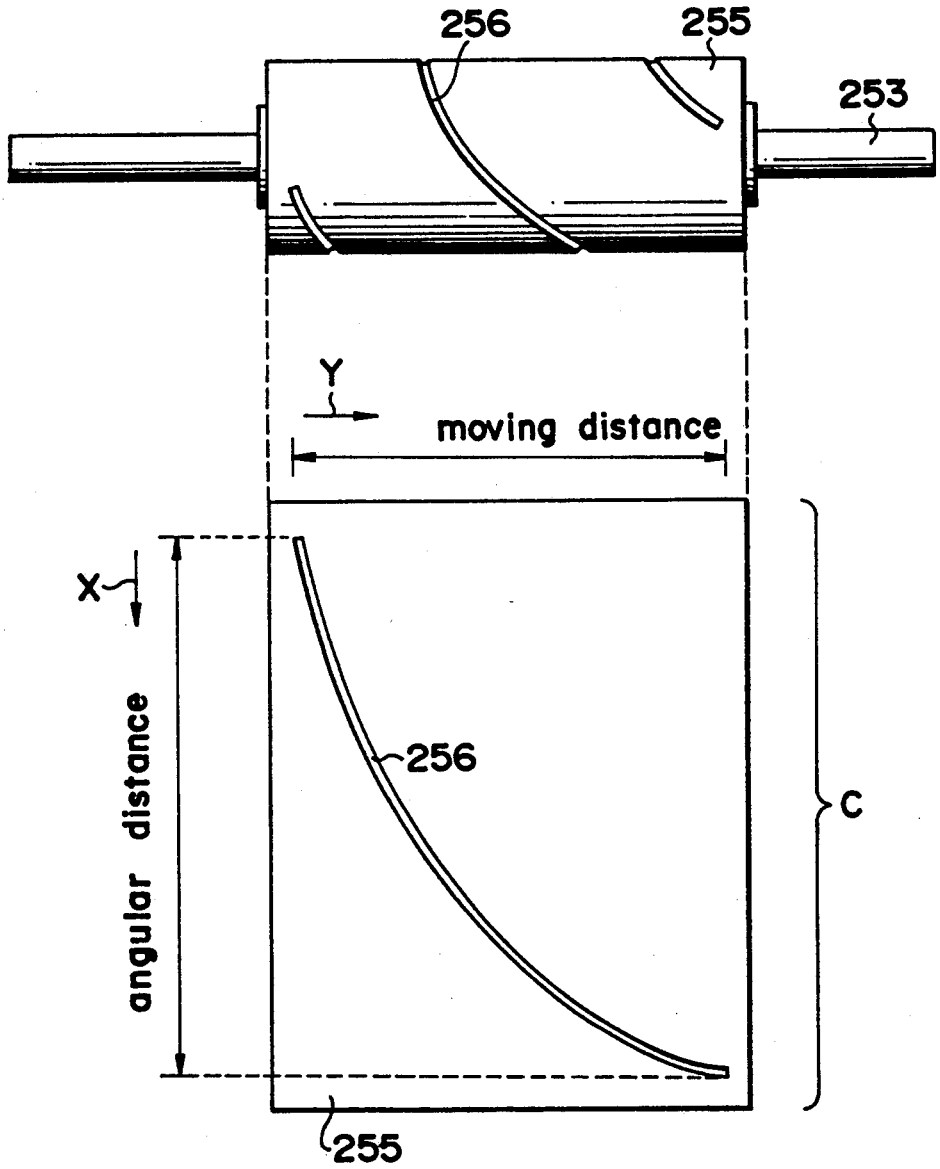
FIG. 28 is a view showing a groove of a cam of a correction cam body employed in the tuning device of FIG. 24 and a graph showing the relation between the moving distance of the slider in FIG. 26 and a turning angle of a lower boom.

FIG. 28 shows the shape of the cam groove 256 defined in the correction cam body 255, C being a planar projection of the peripheral surface of the correction cam body 255. The cam groove 256 defined by cutting the outer periphery of the correction cam body 255 is not of linear proportional shape but is shaped so that the slider 271 can move relative to the turning angle of the correction cam body 255 in a predetermined functional relation. Accordingly, the distance Y where the slider 271 moves is based on the turning angle X of correction cam body 255, i.e. the turning angle of the pin 207 is corrected to have the relation of the moving distance Y of the slider 271 relative to the turning angle X of the correction cam body 255, namely, the former is obtained by the conversion of the latter. The linear displacement of slider 271 is related to the angular displacement of cam body 255, which is in turn related to the angular displacement of the pin 207.

The curvature of the cam groove 256 will be described more in detail with reference to FIG. 29 which shows a relation between the inclination angle Θ and the elongation amount L of the telescopic boom body 213. That is, the length of the telescopic boom body 213 (when retracted) is S which is the same length as the chassis, while the length of the same from the tip end of the telescopic boom body 213 to the pin 207 should be S+L when the telescopic boom body 213 is inclined at the inclination angle Θ. As the telescopic boom body 213 elongates for the length of L relative to the inclination angle Θ, the trace of the wire hanger 237 is perpendicular to the chassis 201 as illustrated in a chain line in FIG. 29. The platform 216 is vertically raised relative to the chassis 201 by the correcting motion. The inclination angle Θ is related to the elongation motion of the telescopic boom body 213 at the amount of elongation amount L. That is, the elongation amount L is small when the inclination angle Θ is small while the elongation amount L is large when the inclination angle Θ is large. The relation between the inclination angle Θ and the elongation amount L can be expressed as a given function. Accordingly, the shape of the cam groove 256 is determined by the curvature of such function.

The inclination angle Θ of the telescopic boom body 213 is converted into the turning angle X of the correction cam body 215 while the elongation amount L of the telescopic boom body 213 is converted into the moving distance Y. That is, the turning angle X as illustrated in FIG. 28 corresponds to the inclination angle Θ of the telescopic boom body 213 as illustrated in FIG. 29 while the moving distance Y as illustrated in FIG. 28 corresponds to the elongation amount L of the telescopic boom body 213 as illustrated in FIG. 29. In such a manner, the amount of elongation of the telescopic boom body 213 relative to the inclination angle Θ to which the pin 207 is turned is converted by the correction cam body 255 so that the requisite elongation amount L can be corrected by using the moving distance Y of the slider 271.

Figure 30:
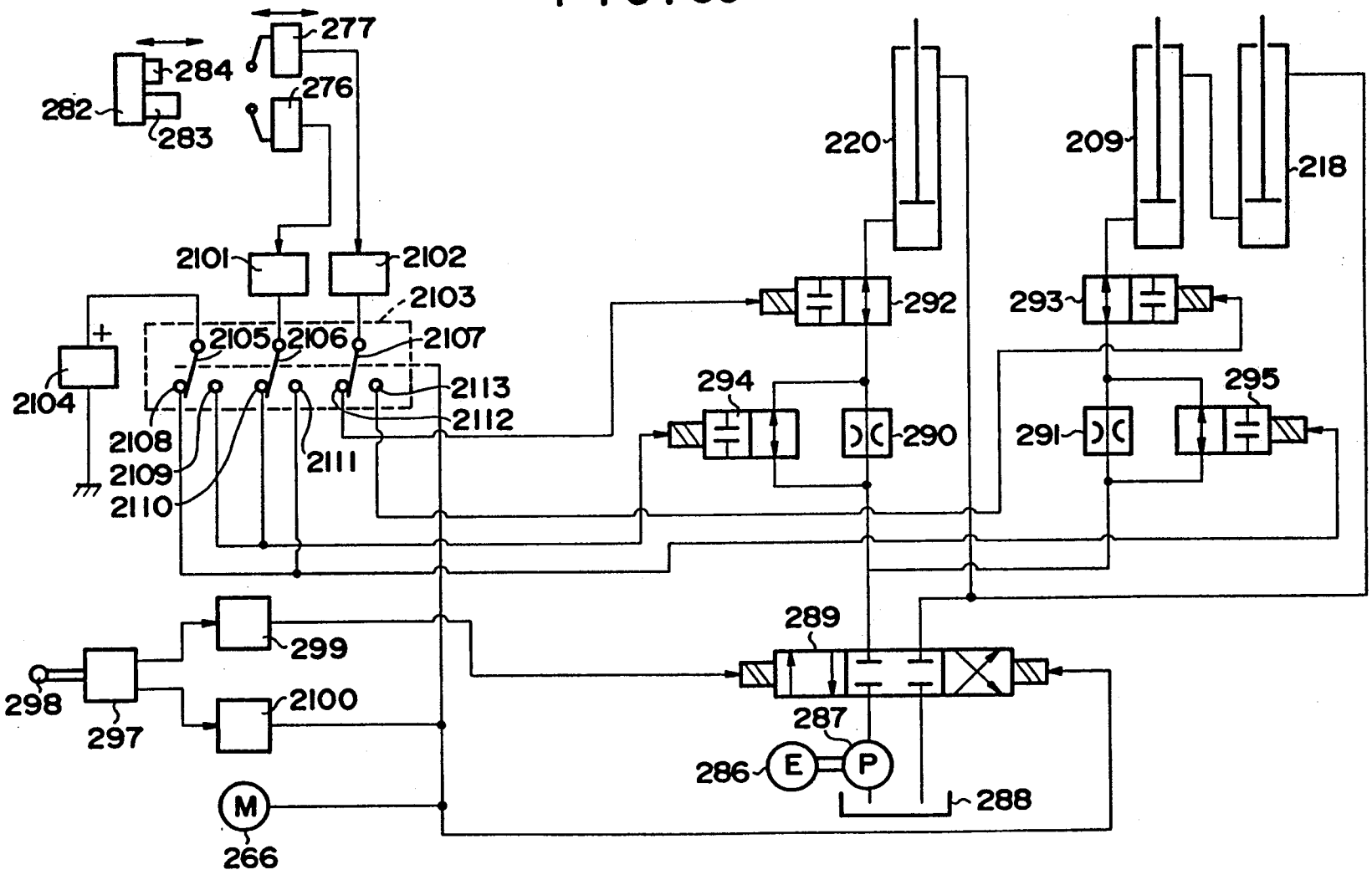
FIG. 30 is a hydraulic circuit diagram showing a control system of the lifting apparatus according to the second embodiment.

Referencing FIG. 30, a control unit 297 is fixed to the platform 216 and is provided with an operating lever 298. When the operating lever 298 of the control unit 297 is operated, the control unit 297 issues an instruction to raise or lower the platform 216. An output of the control unit 297 is connected to a raising instruction circuit 299 and a lowering instruction circuit 2100 while an output of the raising instruction circuit 299 is connected to a "normal open position" coil of a control valve 289. An output of the lowering instruction circuit 2100 is connected to a motor 266 and a "backward open position" coil of the control valve 289 and at the same time to a switching device 2103.

The switching device 2103 has swingable switching contacts 2105, 2106 and 2107 inside thereof. The switching contacts 2105, 2106 and 2107 define interlocking switches which are selectively switchable in two directions. An output of the microswitch 276 is supplied to a correction circuit 2101 and an output of the correction circuit 2101 is connected to the switching contact 2106. An output of the microswitch 277 is connected to a correction circuit 2102 and an output of the correction circuit 2102 is connected to the switching contact 2107. A power source for supplying always a positive potential is connected to the switching contact 2105. Fixed contact points 2108 to 2113 confront the switching contacts 2105, 2106 and 2107. The fixed contact points 2108 and 2111 are connected to the coil of a solenoid synchronous valve 295 while the fixed contact points 2109 and 2110 are connected to the coil of a bypass solenoid synchronous valve 294 (hereinafter referred as a solenoid synchronous valve 294). The fixed contact point 2112 is connected to the coil of a stop valve 292 while the fixed contact point 2113 is connected to the coil of a stop valve 293.

Figure 18:
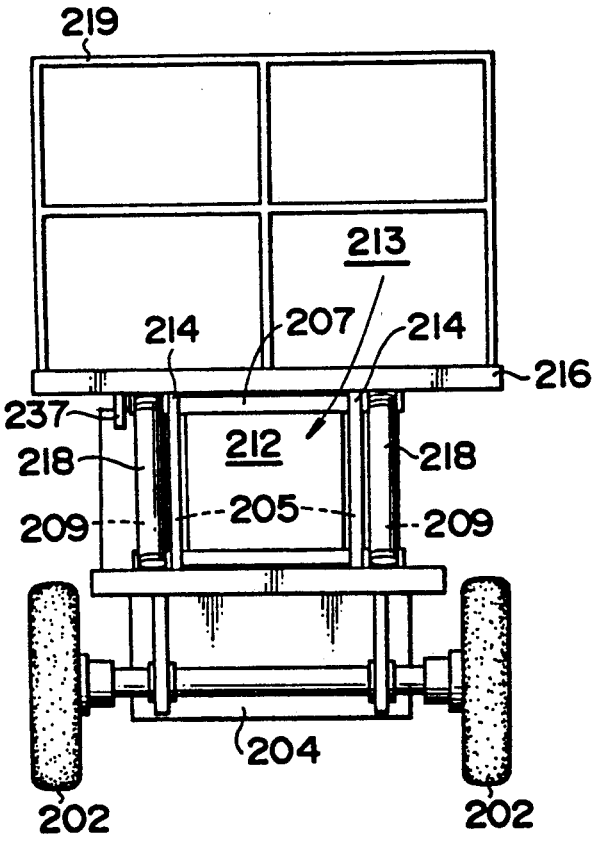
FIG. 18 is a front view of the lifting apparatus in FIG. 17.

FIGS. 17 and 18 are views showing the states where the telescopic boom body 213 is contracted to thereby lower the platform 201 to its lowest position. At this state, the operator and/or the material are respectively loaded on the platform 201 and the platform 201 is raised. Firstly, to raise the platform 201, the engine 286 provided in a drive box 204 is operated to drive the hydraulic pump 287 (FIG. 30) so that the oil is sucked from an oil tank 288 to place the oil under pressure. The oil under pressure is supplied from the oil tank 288 to the control valve 289, and is thereafter supplied to the first to third hydraulic cylinders 209, 218 and 220 so that the platform 216 is raised or lowered.

When the operator operates to push the operating lever 298 of control unit 297 to the raising position, the control unit 297 issues a signal which is supplied to the raising instruction circuit 299. The signal is supplied from the raising instruction circuit 299 to the "normal open" electromagnetic coil of the control valve 289, whereby the control valve 289 is switched to the "normal open" position. As a result, the oil under pressure from the hydraulic pump 287 is supplied to the third hydraulic cylinder 220 and is also supplied to the first hydraulic cylinder 209. The oil under pressure discharged from the third hydraulic cylinder 220 is returned to the oil tank 288 while the oil under pressure discharged from the first hydraulic cylinder 209 is supplied to the second hydraulic cylinder 218 to elongate the rod of the second hydraulic cylinder 218. The oil under pressure discharged from the second hydraulic cylinder 218 is returned to the oil tank 288 by way of the control valve 289. Since the first and second hydraulic cylinders 209 and 218 are serially connected to each other, both the first and second hydraulic cylinders 209 and 218 always elongate at the same rate so that the platform 216 is always kept in parallel with the chassis 201 irrespective of the inclination angle of the telescopic boom body 213. In such a manner, the third hydraulic cylinder 220 and the first and second hydraulic cylinders 209 and 218 are simultaneously operated so that the telescopic boom body 213 is elongated to the entire length thereof and inclined relative to the chassis 201 due to the elongation of the first hydraulic cylinder 209.

When the oil under pressure is supplied to the hydraulic cylinders 209 and 218, the rods of the first and second hydraulic cylinders 209 and 218 respectively move longitudinally whereby the lower boom 206 is turned upward, thereby rotating the pin 207 fixed thereto. As a result, the telescopic boom body 213 is inclined upwardly gradually, relative to the chassis 201.

When the oil under pressure is supplied to the third hydraulic cylinder 220 by way of the solenoid synchronous valve 294 and the stop valve 292, the oil under pressure operates to telescopically elongate the telescopic boom body 213. That is, a middle boom 210, which is longitudinally slidable in the lower boom 206, is pulled out from the lower boom 206 while an upper boom 211, which is longitudinally slidable in the middle boom 210, is pulled out from the middle boom 210 so that the distance between the pins 207 and the pin 215 is increased. During the telescopic movement, rollers 224 contact the upper surface of the lower boom 206 and move lengthwise on the upper surface of the lower boom 206 while rolling thereon.

Inasmuch as there are gaps between a cover body 212 and the lower boom 206, the middle boom 210 and the upper boom 211, play is likely to occur in the gaps whereby the telescopic boom body 213 is liable to be deformed. However, the load of the platform 216 is transmitted to pin holes 222 by way of the second hydraulic cylinders 218 so that the stress for bending downward is applied to the cover body 212 because the stress is applied on the pin holes 222. Since the rollers 224 roll on the upper surface of the lower boom 206, the load of the platform 216 is supported by the rollers 224 and from thence is transmitted to the lower boom 206, and thus the cover body 212 is not deformed and moves upwardly together with the upper boom 211.

When the lower boom 206 moves relative to the cover body 212, the upper end of the lower boom 206 passes under the lower surfaces of the rollers 224. However, since the upper end of the upper boom 211 slides so as to move away from the upper end of the middle boom 210 and is pulled out from the middle boom 210 when the telescopic boom body 213 is telescopically moved, chains 243 are pulled out from the inside of the upper boom 211 and roll on a rail 246 so as to rotate sprocket wheels 241 and 242. Since the chains 243 slide on the rail 246, the chains 243 move smoothly and at the same time the rollers 244 fixed to the chains 243 are also moved.

Accordingly, the rollers 244 fixed to the chains 243 are also moved together with the upper boom 211 so that each roller 244 moves into the space defined between the upper boom 211 and the cover body 212. These rollers 244 roll on the inner wall of the cover body 212 while contacting the inner wall so that the load of the platform 216 applied to the cover body 212 is transmitted to the upper end of the upper boom 211 by way of the rollers 244, the chains 243 and the rail 246. Even when the rollers 224 are moved away from the lower boom 206, the cover body 212 is not likely to be deformed by the load applied to the cover body 212 because each roller 244 contacts the inner wall of the cover body 212.

Figure 31:
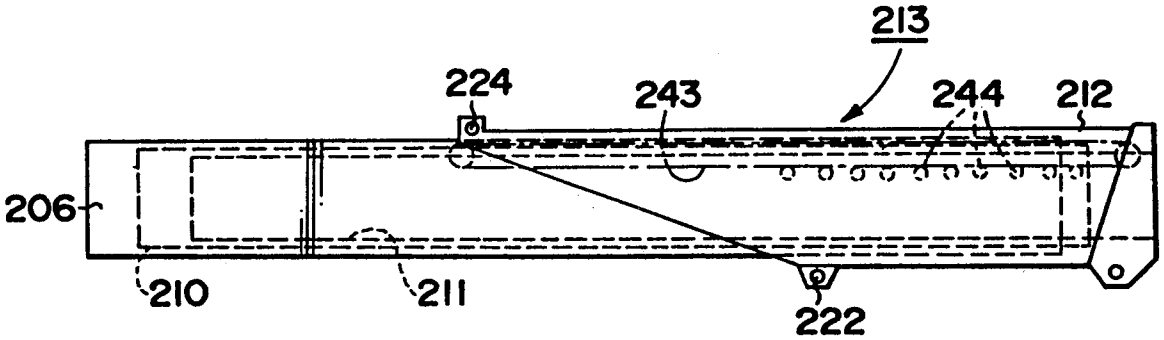
FIG. 31 is a view showing the state where the telescopic boom body in FIG. 20 is contracted.
Figure 32:
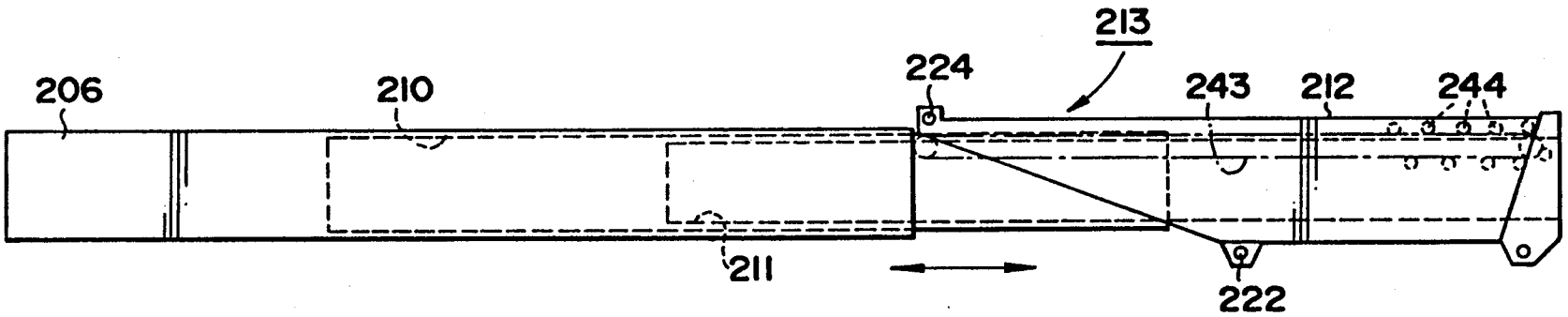
FIG. 32 is a view showing the state where the telescopic boom body in FIG. 20 is midway through contraction.

FIG. 31 shows the telescopic boom body 213 in a first state wherein the load applied to the pin holes 222 is supported by the rollers 224. With further advancement of the telescopic elongating operation of the telescopic boom body 213, the lower boom 206 is pulled out from the cover body 212 so that the rollers 224 are moved away from the upper surface of the lower boom 206 (refer to FIG. 32). At this time, the rollers 244 were already pulled out by the middle boom 210 between the upper boom 211 and the cover body 212 so that the load applied to the pin holes 222 is transmitted to the cover body 212 by way of the rollers 244 and the like, thereby keeping the spacing between the cover body 212 and the upper boom 211 and keeping them in parallel relationship.

Figure 33:
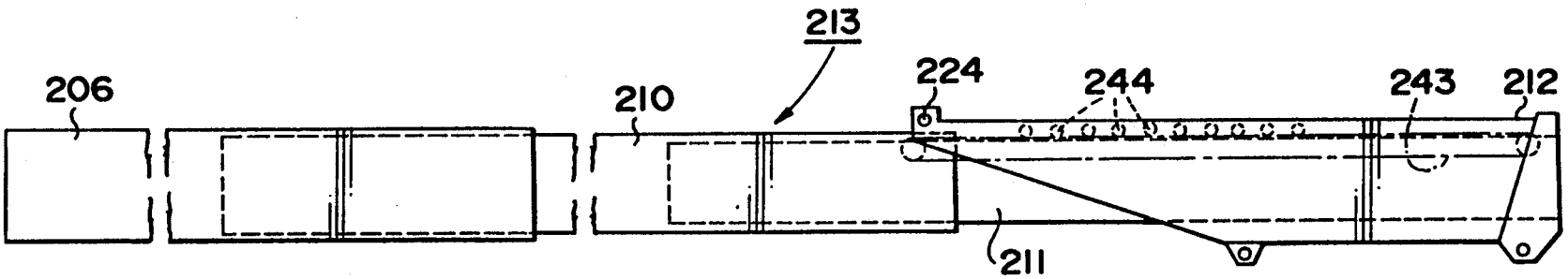
FIG. 33 is a view showing the state where the telescopic boom body in FIG. 20 is extended.

When the middle boom 210 is pulled out from the lower boom 206, the distance between the tip end of the upper boom 211 and the middle boom 210 is increased so that the rollers 244 are disposed in equal intervals and roll between the upper boom 211 and the cover body 212 while the upper boom 211 is successively pulled out from the middle boom 210 and finally stopped at the state as illustrated in FIG. 33 which shows the maximum elongation position of the telescopic boom body 213. The telescopic boom body 213 can smoothly move telescopically by the contact and rolling support between the telescopic boom body 213 and the rollers 224.

When the telescopic boom body 213 is contracted, the telescopic boom body 213 moves in the manner that the upper boom 211 is inserted into the middle boom 210 while the chains 243 move in the opposite direction so that the rollers 244 are accommodated inside the upper boom 211. When the upper end of the lower boom 206 contacts the lower end of the cover body 212, the rollers 224 start to roll on the upper surface of the lower boom 206. As a result, the telescopic boom body 213 operates in the order of states illustrated in FIGS. 33 to 31 so that the load applied to the cover body 212 can be first applied to the rollers 244 and then applied to the rollers 224. Although the rollers 244 serving a spacers are cylindrical according to the present invention, the spacers may be square or polygonal if they fill the space between the cover body 212 and the upper boom 211 and are capable of operating in the same manner as the rollers 244.

As mentioned above, the telescopic boom body 213 is inclined by the first hydraulic cylinders 209 and at the same time it is elongated in the longitudinal direction thereof by the third hydraulic cylinder 220. At this time, since the oil under pressure is supplied to the second hydraulic cylinder 218 from the first hydraulic cylinder 209, the second hydraulic cylinder 218 elongates in synchronism with the first hydraulic cylinder 209. The second hydraulic cylinder 218 operates to increase the angular spacing between the telescopic boom body 213 and the platform 216. When the elongation amounts of the first and second hydraulic cylinders 209 and 218 become equal to each other, the angular spacing between the chassis 201 and the telescopic boom body 213 becomes equal to the angular spacing between the platform 216 and the telescopic boom body 213. Accordingly, the lifting apparatus is substantially Z-shaped when viewed from the side thereof and the platform 216 is always kept in parallel with the chassis 201 for preventing an operator or material loaded on the platform 216 from dropping off the platform.

When the first, second and third hydraulic cylinders 209, 218 and 220 are cooperatively operated, the telescopic boom body 213 is inclined relative to the chassis 201 and the platform 216 is always maintained in parallel with the chassis 201. However, if the first, second and third hydraulic cylinders 209, 218 and 220 operate arbitrarily, the platform 216 cannot rise vertically relative to the chassis 201 even if it can rise upwardly. As a result, the platform 216 can rise while the height of the platform from the chassis 201 varies at the front and rear portions thereof, which makes the platform 216 extremely unstable. If the elongating operation of the first hydraulic cylinder 209 is made first, the telescopic boom body 213 is inclined to a large extent, which causes the telescopic boom body 213 to fall down in the rear direction. If the elongating operation of the third hydraulic cylinder 220 is made fast, the elongation amount of the telescopic boom body 213 is increased, and the center of gravity moves to the front of the chassis 201, which causes the telescopic boom body 213 to fall down in the forward direction. Accordingly, it is impossible to raise the platform 216 vertically relative to the chassis 201 if the first and second hydraulic cylinders 209 and 218 are not synchronous with the third hydraulic cylinder 220 The synchronization of inclination and elongation of the telescopic boom body 213 will now be described.

In the case of raising the platform 216, the lever 298 is pushed upward so that the control unit 297 supplies a signal to the raising instruction circuit 299 so that the control valve 289 is selected to the "normal open" position. The oil under pressure in the hydraulic pump 287 is supplied to the third hydraulic cylinder 220 so that the telescopic boom body 213 is elongated. At the same time, since the oil under pressure from the control valve 289 is supplied in parallel to the first and the second hydraulic cylinders 209 and 218, the first and second hydraulic cylinders 209 and 218 are elongated simultaneously so that the telescopic boom body 213 is inclined upward relative to the chassis 201. In such a manner, the lifting apparatus is formed in a Z-shape by the chassis 201, the telescopic boom body 213 and the platform 216 raised over the chassis 201.

When the first hydraulic cylinder 209 is elongated, the lower boom 206 is raised so that the lower boom 206, which was positioned in parallel with the chassis 201, is inclined about the pin 207. Since the lower end of the lower boom 206 is fixed to the pin 207, the pin 207 is turned together with the lower boom 206 at the inclination angle $\Theta$ of the lower boom 206 relative to the chassis 201. The turning force of the pin 207 is transmitted to the gear 258 to thereby turn the synchronous shaft 253 by way of the chain 259 and the gear 257. When the synchronous shaft 253 is turned, the correction cam body 255 is turned. Since the turning speed of the correction cam body 255 is increased by the ratio of the numbers of teeth of the gears 257 and 258, the turning speed of the correction cam body 255 is greater than the turning speed of the pin 207. Inasmuch as the wedge-shaped tip end of the contact body 274 contacts the cam groove 256 which is defined on the outer peripheral surface of the correction cam body 255, the contact body 274, i.e. the entire slider 271, moves (rightwardly in FIG. 25) in the longitudinal direction of the guide rail 270 according to the position of the cam groove 256. In the series of motions, the inclination angle $\Theta$ between the lower boom 206 and the chassis 201 is converted into the linear moving amount of the slider 271.

The entire length of the telescopic boom body 213 is elongated by the actuation of the third hydraulic cylinder 220. In this case, the detection wire 238, which is connected to the wire hanger 237 at the tip end thereof, is drawn from the tuning device 239 as the telescopic boom body 213 elongates. Since the detection wire 238 is wound around the winding drum 263 in the tuning device 239, the winding drum 263 is turned as the detection wire 238 is drawn out with the wire hanger 237 due to the elongation of the telescopic boom body 213. When the winding drum is turned, both the synchronous shaft 252 and the proportional cam body 261 are turned. Since the wedge-shaped tip end of the contact body 282 contacts the cam groove 262 of the proportional cam body 261, the contact body 282, i.e. the slider 272, is forced to slide (rightwardly in FIG. 25) in the longitudinal direction of the guide rail 269. The linear motion of the detection wire 238, which is drawn by the wire hanger 237, is thus converted into the linear motion of the slider 272 along the guide rail 269. The motion amount of the slider 272 depends on the pitch of the cam groove 262. The moving distance of the slider 272 from one end of the proportional cam body 261 to another end thereof is proportional to the length of the telescopic boom body 213 extending from the maximum contracted state to the maximum elongated state and the moving distance of the slider 272 is thus related to the elongating length of the telescopic boom body 213.

Figure 29:
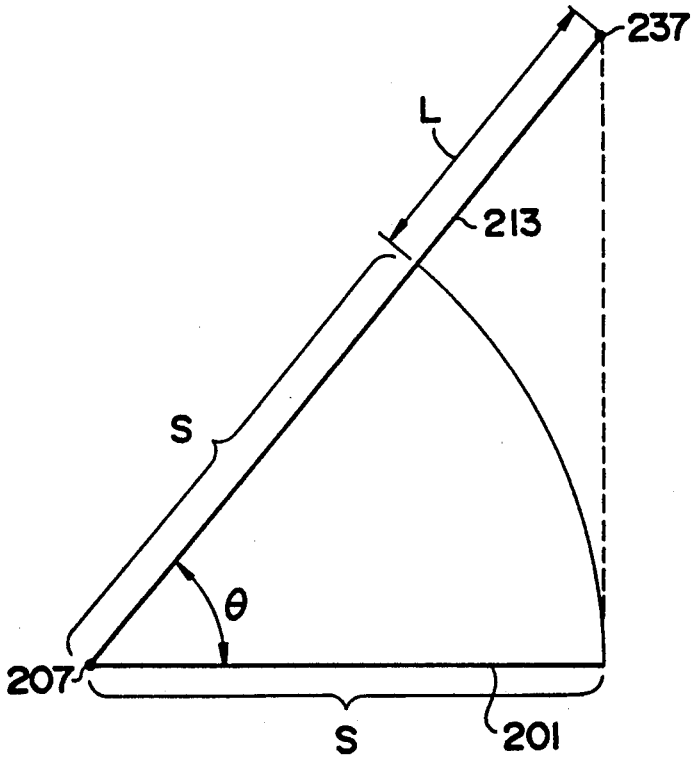
FIG. 29 is a view of assistance in explaining the relation between the extension and turning angle of the telescopic boom body.

As illustrated in FIG. 29, the amount of oil under pressure of the two groups of hydraulic cylinders, i.e. the first and second cylinders 209 and 218 and the third hydraulic cylinder 220 should be corrected in order to move the tip end of the telescopic boom body 213 perpendicularly relative to the chassis 201. The operation to correct the amount of oil under pressure is carried out by the tuning device 239 and the hydraulic circuit, which is described hereinafter.

When the lever 298 is pushed upward, the raising instruction circuit 299 issues the raising instruction to the coil of the "normal open" position of the control valve 289. At this time, since the switching contact 2105 of the switching device 2103 contacts the fixed contact point 2108, the current from the fixed contact point 2108 is supplied to the solenoid synchronous valve 295 to close the same valve 295. However, since no current is supplied to the solenoid synchronous valve 294, the same valve 294 is open. Accordingly, the amount of oil under pressure which is supplied from the control valve 289 to the first hydraulic cylinder 209 by way of the throttle valve 291 is different from the amount of oil under pressure which is supplied from the control valve 289 to the third hydraulic cylinder 220 by way of the solenoid synchronous valve 294 so that the third hydraulic cylinder 220 elongates faster than the first hydraulic cylinder 209. At this time, the pressing members 283 and 284 do not contact the microswitches 276 and 277.

Since the amount of oil under pressure supplied to the first hydraulic cylinder 209 is different from that of the third hydraulic cylinder 220, the elongation amount of the telescopic boom body 213 is expedited by the elongation of the third hydraulic cylinder 220 so that the detection wire 238 is drawn faster. Since the turning speed of the winding drum 263 is increased, the turning speed of the proportional cam body 261 is also increased so that the slider 272 moves to approach the slider 271. When the slider 272 approaches and contacts the slider 271, the pressing member 283 contacts the operative contact member 278 to thereby turn on the microswitch 276. The signal issued by the microswitch 276 is supplied to the correction circuit 2101. The signal issued by the correction circuit 2101 is supplied to the solenoid synchronous valve 294 by way of the switching contact 2106 and the fixed contact point 2110 to thereby close the solenoid synchronous valve 294. Although the oil under pressure previously passed through the solenoid synchronous valve 294 as a bypass route to expedite the elongation amount of the third hydraulic cylinder 220, the oil under pressure is now supplied to the third hydraulic cylinder 220 by way of the throttle valve 290 because the solenoid synchronous valve 294 is closed. As a result, the elongation amount of the third hydraulic cylinder 220 is reduced so that the elongation amount of the telescopic boom body 213 is also reduced. However, if the third hydraulic cylinder 220 elongates still further by inertia force, the slider 272 approaches closer to the slider 271 so that the pressing member 284 contacts the operative contact member 279 of the microswitch 277, thereby turning on the microswitch 277.

The signal issued by the microswitch 277 is supplied to the correction circuit 2102 and the signal issued by the correction circuit 2102 is supplied to the stop valve 292 by way of the switching contact 2107 and the fixed contact point 2112, to thereby close the stop valve 292. Accordingly, if the third hydraulic cylinder 220 further elongates by inertia force, the hydraulic circuit of the third hydraulic cylinder 220 is closed by the stop valve 292 so that the elongating motion of the third hydraulic cylinder 220 is temporarily stopped.

However, even if the third hydraulic cylinder 220 is temporarily stopped, the first hydraulic cylinder 209 continues to elongate so that the lower boom 206 turns the pin 207 and is inclined since the oil under pressure is still supplied to the first hydraulic cylinder 209 from the throttle valve 291. The turning force of the pin 207 is transmitted to the synchronous shaft 253 and the correction cam body 255, in the same manner as mentioned above, so that the synchronous shaft 253 and the correction cam body 255 are continuously turned. As a result, the slider 271 keeps moving rightward in FIG. 25. As the slider 271 moves away from slider 272, the microswitches 276 and 277 are turned off, thereby opening the valves 294 and 292 so that slider 272 again follows slider 271 as described above.

The slider 272 moves following the slider 271, and seemingly the elongating speed of the telescopic boom body 213 follows the inclining speed of the same. As a result, the elongation amount L relative to the inclination angle as illustrated in FIG. 29, is determined by the setting value of the cam groove 256 so that the wire hanger 237, which is positioned at the tip end of the telescopic boom body 213 is corrected to raise vertically relative to the surface of the chassis 201.

In such a manner, the platform 216 is kept horizontal as it is vertically raised relative to the chassis 201 while the first, second and third hydraulic cylinders 209, 218 and 220 are respectively automatically controlled. When the platform 216 is positioned at the predetermined height, the lever 298 is returned to its original position so that the raising instruction circuit 299 stops the output signal, thereby closing the valve 289. The first, second and third hydraulic cylinders 209, 218 and 220 are thus kept elongated because the control valve 289 is closed. As a result, the platform 216 is kept positioned at the predetermined height so that the operator on the platform 216 can engage in building construction or painting work.

In case of lowering the platform 216, the operator 15 pushes the lever 298 downward so that the lowering instruction circuit 2100 issues the lowering instruction signal by the operation of the control unit 297. The lowering instruction circuit 2100 issues the signal to the opposite side ("backward open") coil of the control valve 289 so that the oil under pressure is supplied via control valve 289 in the opposite direction. At the same time, the motor 266 is operated to rotate reversely the synchronous shaft 252 by way of the gear 267, the chain 268 and the gear 265 so that the winding drum 263 is rotated reversely, for thereby winding the detection wire 238. This is made to carry out the correct synchronous control to prevent the detection wire 238 from slackening. The output signal of the lowering instruction circuit 2100 is supplied to the switching device 2103 to thereby switch the switching contacts 2105, 2106 and 2107 at the same time whereby the switching contact 2105 is pushed toward the fixed contact point 2109 while the switching contact 2106 is pushed toward the fixed contact point 2111 and the switching contact 2107 is pushed toward the fixed contact point 2113. As a result, the current supplied from the power source 2104 is supplied to the solenoid synchronous valve 294 by way of the fixed contact point 2109 to thereby close the solenoid synchronous valve 294. Accordingly, the amount of oil under pressure, which is supplied to and from the third hydraulic cylinder 220, is less than the amount of the oil under pressure, which is supplied to the first hydraulic cylinder so that the contracting speed of the third hydraulic cylinder 220 is less than that of the first hydraulic cylinder 209. Since at this time the solenoid synchronous valve 295 is open, the oil under pressure does not pass the throttle valve 291 but rather passes through the solenoid synchronous valve 295.

The contracting operation of the third hydraulic cylinder 220 is started since the oil under pressure is supplied to the third hydraulic cylinder 220. Accordingly, the length of the telescopic boom body 213 is contracted whereby the detection wire 238, which is stretched at the given tension is wound around the winding drum 263 so that the synchronous shaft 252 and the proportional cam body 261 are simultaneously rotated in response to the winding speed thereof. Since the wedge-shaped tip end of the contact body 282 contacts the cam groove 262, the contact body 282, i.e. the slider 272, moves linearly to the left in FIG. 25. At the same time, since the first hydraulic cylinder 209 is contracted, the telescopic boom body 213 lowers the inclination angle so that the lower boom 206 of the telescopic boom body 213 is turned together with the pin 207. The turning force of the pin 207 is transmitted to the synchronous shaft 253 by way of the gear 258, the chain 259 and the gear 257, to thereby rotate the correction cam body 255 in the reverse direction from that set forth above. Accordingly, the wedge-shaped tip end of the contact body 274 moves in accordance with the cam groove 256. The contact body 274, i.e. the slider 271, moves from the right side to the left side in FIG. 25 along the longitudinal direction of the guide rail 270.

At this time, since the solenoid synchronous valve 294 is closed and the solenoid synchronous valve 295 is open, the contracting speed of the third hydraulic cylinder 220 is slower than the contracting speed of the first hydraulic cylinder 209. Accordingly, the moving speed of the slider 271 accompanied by the contraction of the first hydraulic cylinder 209 is set faster than the moving speed of the slider 272 accompanied by the contraction of the third hydraulic cylinder 220 so that the movement of the slider 271 follows the movement of the slider 272.

When the slider 271 approaches the slider 272, the operative contact member 278 of the microswitch 276 contacts the pressing member 283 so that the microswitch 276 issues an output signal. This output signal is supplied to the correction circuit 2101 and thereafter to the solenoid synchronous valve 295 by way of the fixed contact point 2111 so that the solenoid synchronous valve 295 is closed. Accordingly, the amount of oil under pressure which is supplied from the control valve 289 is restricted by the throttle valve 291 so that the contracting speed of the first hydraulic cylinder 209 is reduced. The lower boom 206, which has been inclined at high speed so far, is slowed because of the restriction of the flow of the oil under pressure due to the closing of the valve 295 and the flow restriction of the throttle valve 291 so that the lower boom 206 follows the contracting speed of the telescopic boom body 213. However, unless the contracting speed of the first hydraulic cylinder 209 is reduced by inertia, the inclining speed of the lower boom 206 is maintained so that the correction cam body 255 is still turned and the slider 271 further approaches the slider 272. As a result, the operative contact member 279 of the microswitch 277 contacts the pressing member 284 so that the microswitch 277 is turned on to thereby supply the signal to the correction circuit 2102. The signal issued by the correction circuit 2102 is supplied to the stop valve 293 by way of the switching contact 2107 and the fixed contact point 2113, for thereby closing the stop valve 293. Accordingly, the excessive contracting motion of the first and second hydraulic cylinders 209 and 218 is suspended. However, since the oil under pressure returns from the third hydraulic cylinder 220 by way of the throttle valve 290, during the suspension of the contracting motion of the first and second hydraulic cylinders 209 and 218, the third hydraulic cylinder 220 is slowly contracted so that the entire length of the telescopic boom body 213 keeps contracting.

The detection wire 238 is wound around the winding drum 263 due to the contraction of the telescopic boom body 213 while the slider 272 keeps moving from the right side to the left side in FIG. 25. When the slider 272 moves again away from the slider 271, the contact between the pressing member 284 and the operative contact member 279 and the contact between the pressing member 283 and the operative contact member 278 are respectively released while the stop valve 293 and the solenoid synchronous valve 295 are respectively opened so that the slider 271 moves to follow the slider 272 in the same manner set forth above. When the slider 271 follows the slider 272, the first and second hydraulic cylinders 209 and 218 and the third hydraulic cylinder 220 move in a predetermined function so that the position of the wire hanger 237, i.e. the tip end of the telescopic boom body 213, moves linearly perpendicularly relative to the chassis 201. Accordingly, the platform 216 can lower vertically relative to the chassis 201 while it is kept horizontal relative to the chassis 201.

With the arrangement of the lifting apparatus according to the second embodiment, the inclining means and the telescopical moving means can correct the platform with respect to the chassis by the elongation amount of the single detection wire and the inclination angle of the telescopic boom body. Since the arrangement to control the correction is very simple, it is possible to manufacture and assemble the arrangement with ease. Furthermore, two groups of hydraulic mechanisms, i.e. the inclining means and the telescopic movable means for vertically moving the platform does not necessitate high-priced angle detectors and elongation detectors, and high-priced electronic appliances such as computers, etc. are not needed.

What is claimed is:

1. A lifting apparatus comprising a movable chassis, a platform disposed over the chassis, an elongated telescopic boom body extending between the chassis and the platform, said telescopic boom body comprising a plurality of boom sections which are telescopable into and out of the telescopic boom body in the longitudinal direction thereof, inclining means interposed between the chassis and the telescopic boom body for raising the telescopic boom body so that it is inclined with respect to the chassis, extension means housed within the telescopic boom body for telescoping the boom body to elongate and contract the same, wherein the platform, the telescopic boom body and the chassis are arranged to form a Z-shape when viewed from the side thereof and the telescopic boom body is telescopically moved and inclined relative to the chassis so as to move the platform vertically relative to the chassis while the platform is kept horizontal relative to the chassis, characterized in that: the lifting apparatus further comprises a slave-operated detecting mechanism including first and second winding drums, a first extension wire which has an end fixed to one lower surface of the platform and another end wound around the first winding drum, and a second extension wire which has an end fixed to another lower surface of the platform and another end wound around the second winding drum.

2. A lifting apparatus as claimed in claim 1, wherein the slave-operated detecting mechanism further comprises a first shaft to which the first winding drum is fixed, a second shaft to which the second winding drum is fixed, a pair of supporting plates each having one hole for rotatably supporting the first shaft and a second hole for slidably supporting the second shaft, first and second sprocket wheels fixed to the first and second shafts, a chain which is entrained around the first and second sprocket wheels, a contact plate supported on the second shaft, limit switches positioned at both sides of the contact plate, an arm which is provided with a spring for yieldably tightening the chain, a third sprocket wheel fixed to one end of the first shaft, a fourth sprocket wheel connected to an end of a shaft of a motor, and a chain which is entrained around the third and fourth sprocket wheels.

3. A lifting apparatus as claimed in claim 2, characterized in that the inclining means comprises a first pair of hydraulically operated cylinders pivotally connected to and extending between the chassis and the lowermost boom section of the boom body, the first pair of cylinders being disposed on opposite lateral sides of the boom body.

4. A lifting apparatus as claimed in claim 3, characterized in that the platform is pivotally connected to the uppermost boom section of the boom body, and including a second pair of hydraulically operated cylinders pivotally connected to and extending between the platform and the uppermost boom section for tilting the platform relative to the boom body.

5. A lifting apparatus as claimed in claim 1, characterized in that the boom sections each are hollow and are rectangular in cross-section and are longitudinally slidable and telescopable one within another.

6. A lifting apparatus as claimed in claim 5, characterized in that the boom body comprises coaxial lower, middle and upper boom sections of progressively smaller cross-section, an elongated channel-shaped cover body disposed over the upper end portion of the upper boom section, the walls of the cover body being spaced from the opposing walls of the upper boom section to provide a clearance space therebetween into which the lower and middle boom sections can be received, first roller means on the cover member for rollably supporting the upper boom section on the lower boom section when the boom body is in a position in which the upper boom section and the middle boom section are telescoped within the lower boom section, and second roller means for rollably supporting the cover body on the upper boom section when the middle and upper boom sections are extended from the lower boom section and when the upper boom section is extended from the middle boom section.

7. A lifting apparatus as claimed in claim 1, characterized in that the extension means includes a hydraulic cylinder actuator housed inside the boom body.

8. A lifting apparatus comprising a movable chassis, a platform disposed over the chassis, an elongated telescopic boom body extending between the chassis and the platform, said telescopic boom body comprising a plurality of boom sections which are telescopable into and out of the telescopic boom body in the longitudinal direction thereof, inclining means interposed between the chassis and the telescopic boom body for raising the telescopic boom body so that it is inclined with respect to the chassis, extension means housed within the telescopic boom body for telescoping the boom body to elongate and contract the same, wherein the platform, the telescopic boom body and the chassis are arranged to form a Z-shape when viewed from the side thereof and the telescopic boom body is telescopically moved and inclined relative to the chassis so as to move the platform vertically relative to the chassis while the platform is kept horizontal relative to the chassis, characterized in that: the lifting apparatus further comprises a tuning device including a winding drum, and a detection wire which has an end fixed to one lower surface of the platform and another end wound around the winding drum.

9. A lifting apparatus as claimed in claim 8, wherein the tuning device further comprises a first supporting bracket spaced from a second supporting bracket, first and second synchronous shafts which are turnably supported by the supporting brackets, a supporting shaft which is supported by the supporting brackets over the first synchronous shaft, a cylindrical connection cam body which is fixed to the central portion of the second synchronous shaft and has an outer periphery provided with a cam groove which is defined by cutting the peripheral surface thereof, a first gear which is fixed to one end of the second synchronous shaft, the first gear and the connection cam body being turned together with the second synchronous shaft, a second gear fixed to a pin which supports the boom body for pivotal movement relative to the chassis, a chain which is entrained around the first and second gears, a cylindrical proportional cam body and a winding drum which are fixed to the first synchronous shaft, the proportional cam body having an outer periphery provided with a cam groove which is defined by cutting the peripheral surface thereof at given pitches, a pulley turnably journaled on the supporting shaft, the detection wire contacting the pulley and being wound around the winding drum, a third gear which is fixed to one end of the first synchronous shaft and disposed outside the first supporting bracket, a fourth gear which is fixed to a rotary shaft of a motor provided between the synchronous shafts, a second chain which is entrained around the third and fourth gears, and first and second guide rails which are disposed in parallel with each other between the supporting shafts.

10. A lifting apparatus as claimed in claim 9, characterized in that the guide rails are long and of square cross-section and disposed in spaced relationship without contacting the outer periphery of the correction cam and the outer periphery of the proportional cam body.

11. A lifting apparatus as claimed in claim 9, characterized in that the tuning device further comprises a first slider which is slidably supported on the first guide rail and a second slider which is slidably supported on the second guide rail.

12. A lifting apparatus as claimed in claim 11, characterized in that the second slider has a guide body at the central portion thereof which is of a square cross section and slidably receives the second guide rail, said second slider being movable in the longitudinal direction of the second guide rail by the guide body, and said second slider also including a long contact body which is placed on the upper surface of the guide body and has a wedge-shaped tip end and an L-shaped angle bracket on the upper surface thereof.

13. A lifting apparatus as claimed in claim 12, characterized in that the angle bracket has microswitches at the lower and upper portions thereof, the microswitches having operative contact members which are respectively directed to the first slider.

14. A lifting apparatus as claimed in claim 11, characterized in that the first slider has a guide body which has a square cross section and slidably receives the first guide rail, a contact body which is placed on the upper surface of the guide body and having a wedge-shaped tip end, and block-shaped pressing members are fixed to the upper and lower portions of the side surface of the contact body in confronted relation with the second slider.

15. A lifting apparatus as claimed in claim 8, characterized in that the inclining means comprises a first pair of hydraulically operated cylinders pivotally connected to and extending between the chassis and the lowermost boom section of the boom body, the first pair of cylinders being disposed on opposite lateral sides of the boom body.

16. A lifting apparatus as claimed in claim 8, characterized in that the platform is pivotally connected to the uppermost boom section of the boom body, and including a second pair of hydraulically operated cylinders pivotally connected to and extending between the platform and the uppermost boom section for tilting the platform relative to the boom body.

17. A lifting apparatus as claimed in claim 8, characterized in that the boom sections each are hollow and are rectangular in cross-section and are longitudinally slidable and telescopicable one within another.

18. A lifting apparatus as claimed in claim 8, characterized in that the boom body comprises coaxial lower, middle and upper boom sections of progressively smaller cross-section, an elongated channel-shaped cover body disposed over the upper end portion of the upper boom section, the walls of the cover body being spaced from the opposing walls of the upper boom section to provide a clearance space therebetween into which the lower and middle boom sections can be received, first roller means on the cover member for rollably supporting the upper boom section on the lower boom section when the boom body is in a position in which the upper boom section and the middle boom section are telescoped within the lower boom section, and second roller means for rollably supporting the cover body on the upper boom section when the middle and upper boom sections are extended from the lower boom section and when the upper boom section is extended from the middle boom section.

19. A lifting apparatus as claimed in claim 8, characterized in that the extension means includes a hydraulic cylinder actuator housed inside the boom body.

* * * * *